US011185883B2

(12) United States Patent
Zong

(10) Patent No.: US 11,185,883 B2
(45) Date of Patent: Nov. 30, 2021

(54) METHODS FOR PREPARING NANO-PROTECTIVE COATING

(71) Applicant: Jiangsu Favored Nanotechnology Co., LTD, Wuxi (CN)

(72) Inventor: Jian Zong, Irvine, CA (US)

(73) Assignee: Jiangsu Favored Nanotechnology Co., Ltd, Wuxi (CN)

( * ) Notice: Subject to any disclaimer, the term of this patent is extended or adjusted under 35 U.S.C. 154(b) by 0 days.

(21) Appl. No.: 16/798,097

(22) Filed: Feb. 21, 2020

(65) Prior Publication Data

US 2020/0188953 A1 Jun. 18, 2020

Related U.S. Application Data

(63) Continuation-in-part of application No. PCT/CN2018/082832, filed on Apr. 12, 2018, and a (Continued)

(30) Foreign Application Priority Data

Aug. 23, 2017 (CN) ..... 201710729368.5
Aug. 23, 2017 (CN) ..... 201710729754.4
Aug. 23, 2017 (CN) ..... 201710730242.X

(51) Int. Cl.
*B05D 1/00* (2006.01)

(52) U.S. Cl.
CPC ..... *B05D 1/62* (2013.01); *B05D 1/60* (2013.01); *B05D 2201/02* (2013.01); (Continued)

(58) Field of Classification Search
CPC ..... B05D 1/62; B05D 1/60; B05D 2201/02
See application file for complete search history.

(56) References Cited

U.S. PATENT DOCUMENTS 4,824,753 A * 4/1989 Hotomi ..... G03G 9/1131 430/111.35
5,364,666 A * 11/1994 Williams ..... A61L 31/084 427/255.37

(Continued)

FOREIGN PATENT DOCUMENTS

CN 106906456 A 6/2017
CN 106958012 A 7/2017

(Continued)

OTHER PUBLICATIONS

International Search Report dated Jun. 22, 2018 cited in PCT/CN2018/082830.

(Continued)

*Primary Examiner* — Dah-Wei D. Yuan
*Assistant Examiner* — Kristen A Dagenais-Englehart
(74) *Attorney, Agent, or Firm* — Perkins Coie LLP

(57) ABSTRACT

Methods and associated systems for preparing a nano-protective coating are disclosed. The method includes (1) placing a substrate in a reaction chamber of a nano-coating preparation equipment; (2) introducing an inert gas, wherein the inert gas includes helium (He) and/or argon (Ar); (3) turning on a movement mechanism so that the substrate is moved in the reaction chamber; (4) introducing a monomer vapor into the reaction chamber to achieve a vacuum degree of 30-300 mTorr; and (5) turning on a plasma discharge for chemical vapor deposition to form an organosilicon nano-coating on a surface of the substrate.

27 Claims, 1 Drawing Sheet

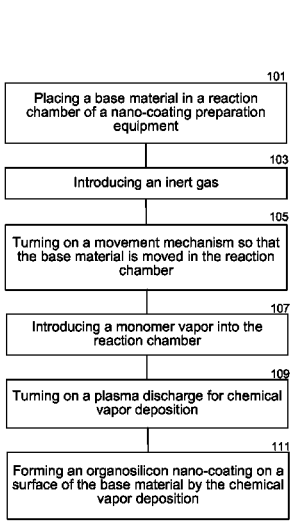

Related U.S. Application Data continuation-in-part of application No. PCT/CN2018/082835, filed on Apr. 12, 2018, and a continuation-in-part of application No. PCT/CN2018/082830, filed on Apr. 12, 2018.

(52) U.S. Cl.
CPC ..... *B05D 2202/15* (2013.01); *B05D 2350/00* (2013.01); *B05D 2518/12* (2013.01)

(56) References Cited

U.S. PATENT DOCUMENTS

| | | | | |
|---|---|---|---|---|
| 2012/0183786 | A1 | 7/2012 | Laroche et al. | |
| 2013/0040102 | A1* | 2/2013 | Gleason | B05D 1/62 428/141 |
| 2015/0247241 | A1* | 9/2015 | Ezure | C23C 16/40 428/446 |

FOREIGN PATENT DOCUMENTS

| | | | |
|---|---|---|---|
| CN | 107523808 | A | 12/2017 |
| CN | 107523809 | A | 12/2017 |
| CN | 107587119 | A | 1/2018 |
| CN | 107587120 | A | 1/2018 |
| CN | 107699868 | A | 2/2018 |
| GN | 1075173 | A | 8/1993 |
| GN | 1125267 | A | 6/1996 |
| GN | 104302412 | A | 1/2015 |
| TW | 448079 | B | 8/2001 |
| WO | 2019037442 | A1 | 2/2019 |
| WO | 2019037443 | A1 | 2/2019 |
| WO | 2019037445 | A1 | 2/2019 |

OTHER PUBLICATIONS

International Search Report dated Jun. 28, 2018 cited in PCT/CN2018/082832.

International Search Report dated Jun. 26, 2018 cited in PCT/CN2018/082835.

Jierong Chen, "Application of Surface Hardening Film", Low Temperature Plasma Chemistry and Its Applications, Jul. 31, 2001, p. 150.

* cited by examiner

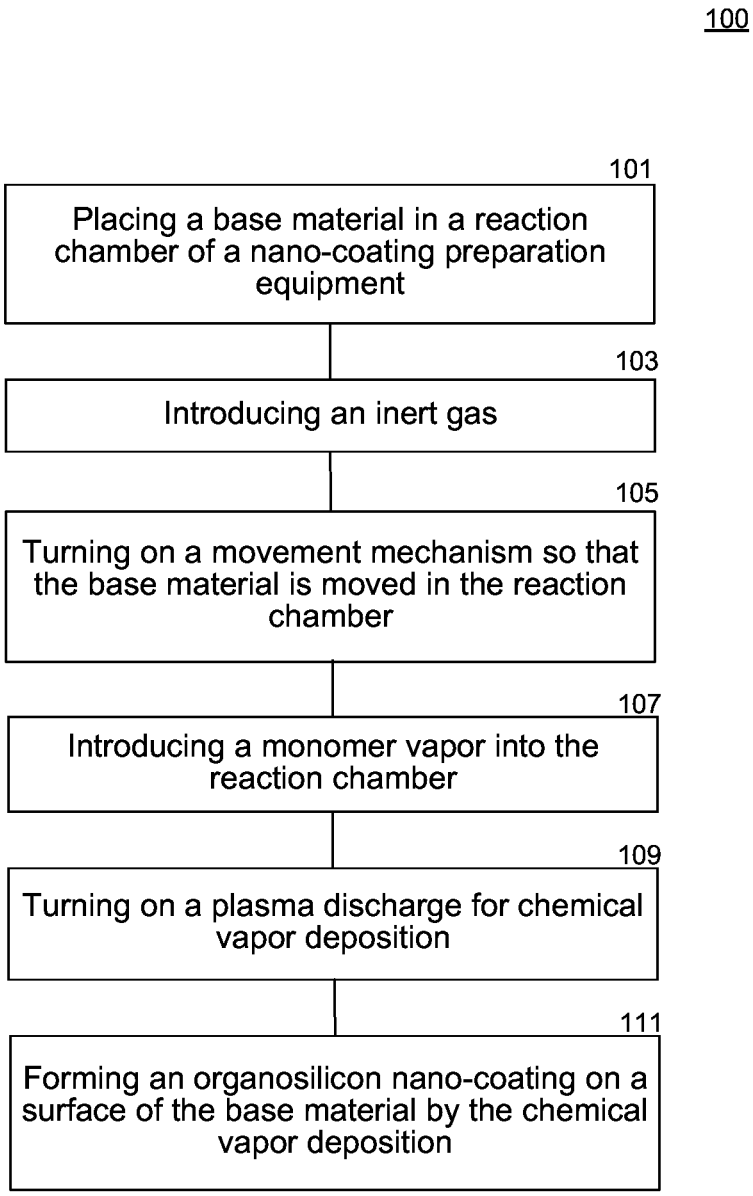
100
101
Placing a base material in a reaction chamber of a nano-coating preparation equipment
103
Introducing an inert gas
105
Turning on a movement mechanism so that the base material is moved in the reaction chamber
107
Introducing a monomer vapor into the reaction chamber
109
Turning on a plasma discharge for chemical vapor deposition
111
Forming an organosilicon nano-coating on a surface of the base material by the chemical vapor deposition

METHODS FOR PREPARING NANO-PROTECTIVE COATING

CROSS-REFERENCE TO RELATED APPLICATIONS

This application is a continuation-in-part of PCT Application Nos. PCT/CN2018/082830 filed on Apr. 12, 2018, which claims priority to Chinese Application No. 201710729754.4 filed Aug. 23, 2017; PCT/CN2018/082832 filed Apr. 12, 2018, which claims priority to Chinese Application No. 201710730242.X filed Aug. 23, 2017; and PCT/CN2018/082835 filed Apr. 12, 2018, which claims priority to Chinese Application No. 201710729368.5 filed Aug. 23, 2017. The aforementioned applications are incorporated herein by reference in their entirety.

TECHNICAL FIELD

The present invention is directed to plasma chemical vapor deposition technology. More particularly, the present invention relates to a method for generating a nano-protective coating, such as an organosilicon nano-protective coating.

BACKGROUND

Corrosive environment is one of the most common causes of damage to electronic devices. Environmental corrosion results in corrosion of solid materials in electronic devices, degradation of conductor/semiconductor insulation, and short circuit, open circuit or poor contact and other faults. At present, the proportion of electronic components in a high-tech product, such as one in defense or aerospace industry, etc., is increasing. Accordingly, the requirements for these components regarding moisture resistance, mildew resistance, and corrosion resistance of electronic products have become stricter. In the field of communication, with the continuous advancement of technology and continuous improvement of communication frequency, the requirements for the heat dissipation of communication equipment and the stability and reliability of signal transmission have become higher and higher. Therefore, a reliable method that can effectively protect circuit boards and electronic components without affecting normal heat dissipation or signal transmission is needed.

Polymer coating is often used to protect the surface of materials due to low cost, easy applications, and a wide range of applications, etc. The polymer coating provides materials with good physical and chemical durability. Based on the barrier characteristic of the polymer coating, a protective film can be formed on the surface of electronic appliances and circuit boards so as to effectively isolate and protect the same from corrosion and damages caused in a corrosive environment. By this arrangement, the reliability of electronic devices is improved, the safety factors are increased, the service lives are ensured. Namely, the polymer coating can be used as an anti-corrosive coating.

Conformal coating is a process of applying a specific material to a PCB to form an insulating and protective layer consistent with the shape of a coated object. It is a commonly used method for waterproofing circuit boards and can effectively isolate the circuit board. It can also protect the circuitry thereof from erosion and damages caused due to a harsh environment. There are also some problems and disadvantages in the preparation of a current conformal coating. For example, solvents used in liquid-phase methods are likely to cause damages to circuit board devices; thermally cured coatings are likely to cause damages to devices at high temperature; and light-cured coatings are difficult to be achieved in the inside of sealed devices. HZO company in the U.S. has developed and applied a conformal parylene coating. The parylene coating is a polymer of p-xylene, whose features include low water, gas permeability and high barrier effect. The parylene coating can achieve the effect of resistance to moisture, water, rust, and acid and alkali corrosion. It is found in research that poly-p-xylene can be generated by deposition in a vacuum state and can be applied to areas that cannot be covered by liquid coatings, such as the protection of high-frequency circuits and extremely weak current systems. The thickness of a polymer film coating is the main factor that results in a protective failure of poly-p-xylene vapor deposition conformal coating. For components on a printed circuit board, polymer film coatings at a thickness of 3 to 7 microns are prone to local rust failure. The coating thickness should be greater and equal to (≥) 30 microns so as to not affecting high-frequency dielectric loss. The parylene coating has high requirements for the pretreatment of components on printed circuit boards that need protection, such as conductive components, signal transmission components, radio frequency components, etc. Shielding pretreatment is needed for circuit board components during a vapor deposition conformal coating process so as to avoid impacts on the performance of the components. The foregoing disadvantages have greatly limited the application of the parylene coatings. Parylene coatings are featured in high raw material cost, harsh preparation conditions (high temperature and high vacuum requirements) and low film formation rate and are difficult to be widely applied. In addition, thick coatings are likely to cause problems such as poor heat dissipation, signal transmission barrier and increased coating defects, etc.

Plasma chemical vapor deposition (PCVD) is a technology that uses plasma to activate a reactive gas to promote a chemical reaction on the surface of a base material (e.g., a substrate) or in a near-surface space to generate a solid film. Plasma chemical vapor deposition coating has the following advantages:

(1) It is a dry process, resulting in a uniform thin film with no pinholes.

(2) The plasma polymer film has stable chemical and physical properties such as solvent resistance, chemical resistance, heat resistance, abrasion resistance, etc.

(3) Plasma polymer film has a good adhesion to substrates.

(4) Uniform films can also be made on extremely irregular substrate surfaces.

(5) The temperature for coating preparation is low and it can be carried out at a normal temperature, which effectively avoids damages to temperature sensitive devices.

(6) Plasma process can not only prepare coatings with micron thickness but also prepare ultra-thin nano-coatings.

During the preparation of existing plasma chemical vapor deposition coatings, substrates are fixed. Whether the substrates are moved is not related to the discharge energy of a plasma. Stationary substrates in the chamber can be treated by a continuous discharge method. The activated chain scission in a monomer generally forms a film by a simple stacking and bonding under the effect of continuous discharge. The resulted coating generally has a loose structure and even a high degree of powdering, which is not helpful for the formation of a coating micro-dense structure. Therefore, it has poor waterproof, moisture-proof, corrosion-resistant, solvent-resistant and other protective properties.

Due to different regional differences in plasma density and chemical raw material density in the reaction chamber, the stationary substrate can also slow down a coating deposition process in some areas, resulting in a low production efficiency and great difference in uniformity and compactness.

In addition, most of the plasma coatings are traditional hydrocarbon organic compounds. Compared with these traditional organic coatings, organosilicon coatings have the characteristics of good environmental protection, high hardness, good wear resistance and good insulation, etc., and are increasingly and widely applied in electronics industry. Organosilicon monomer itself is non-toxic and will not decompose into toxic or harmful substances. After the monomers are polymerized, the polymer coating will have silicon-oxygen bonds or inorganic $SiO_2$ nanoparticles will be formed in the coating, resulting in high hardness, good insulation, and good heat resistance. However, most organosilicon coatings are currently obtained by liquid phase methods. Organosilicon monomer is hydrolyzed in solution to form a sol. The sol is coated on the sample to be treated, and finally heat-cured to form a dense coating on the surface of a prototype. Coating thickness is usually from a few microns to tens of microns. Although liquid-phase organosilicon coating technologies are more environmentally friendly than traditional liquid-phase coating technologies, there are also many shortcomings:

(1) Water or organic substances are needed to be used as solvents, and these solvents adversely affect electronic products;

(2) There is waste water, waste liquid and waste gas, which requires post-treatment; and (3) The coating thickness is poorly controllable and difficult to be controlled at a nano-level.

BRIEF DESCRIPTION OF DRAWINGS

FIG. 1 is a flowchart of a method in accordance with an embodiment of the present invention.

DETAILED DESCRIPTION

The present invention provides methods for preparing an organosilicon nano-protective coating to address the above technical issues. During the preparation process, the movement characteristics of a base material (e.g., a substrate) and a plasma discharge energy are linked. While the plasma discharge energy is released, the substrate stays in a moving state. A cross-linked structure is formed by the introduction of other monomer components with a multifunctional cross-linked structure by plasma energy to introduce additional cross-linking points. Plasma discharge generates plasma. Low temperature plasma can effectively activate active groups with a higher energy in monomer components by controlling the relationship between plasma discharge energy and monomer bond energy so as to obtain active sites. At the same time, the introduced additional active sites cross-link and polymerize with each other in a plasma environment to form a dense network structure.

In addition, the present invention replaces traditional carbon/hydrogen/oxygen organic compound monomers with organosilicon monomers. Since the functional group connected to silicon in the organosilicon monomer is liable to undergo hydrolysis or alcoholysis, the resulted structure is very easy to undergo a condensation reaction and mutually cross-linking. Each silicon atom provides at least 1-4 active sites with a high activity. Thus, it is easier to generate free radicals and undergo a cross-linking reaction under low-temperature plasma conditions so as to form dense cross-linked compounds and improve protection performance. The coating thickness can be precisely controlled from nanometers to microns via a plasma deposition method, and it is not necessary to use a solvent. The present invention also prevents defects such as waste water, waste liquid, and waste gas produced by a liquid phase organosilicon coating method.

The technical solutions adopted by the present invention are as follows: a preparation method for organosilicon nano-protective coating, comprising the following steps.

(A1) Pre-Treatment:

A substrate is placed in a reaction chamber of a nano-coating preparation equipment. The reaction chamber is continuously vacuumized, and the vacuum degree within the reaction chamber is adjusted to 10 to 200 mTorr. An inert gas He, Ar or a mixture of He and Ar is introduced, and a movement mechanism is turned on so that the substrate can be moved in the reaction chamber.

(A2) Preparation of Organosilicon Coating:

A monomer vapor is introduced into the reaction chamber to achieve a vacuum degree of 30-300 mTorr. Plasma discharge is turned on for chemical vapor deposition, and an organosilicon nano-coating is prepared via chemical vapor deposition on a surface of the substrate.

The monomer vapor includes a mixture of (i) at least one organosilicon monomer containing a double bond, Si—Cl, Si—O—C, Si—N—Si, Si—O—Si structure or an annular structure and (ii) at least one polyfunctional unsaturated hydrocarbon or hydrocarbon derivative. The mass fraction of the polyfunctional unsaturated hydrocarbon or hydrocarbon derivative in the monomer vapor is 15-65%.

The monomer vapor is atomized and volatilized through a feeding pump and is then introduced into the reaction chamber at a low pressure of 10-200 mTorr. The flow rate of the introduced monomer vapor is 10-1000 μL/min.

(A3) Post-Treatment:

The monomer vapor is stopped being introduced, and the plasma discharge is stopped at the same time. Vacuumizing is continued. The vacuum degree of the reaction chamber is kept as 10-200 mTorr for 1-5 minutes, and then air is introduced until the pressure of the reaction chamber reaches an atmospheric pressure. The movement of the substrate is stopped and then the substrate is taken out.

Alternatively, in some embodiments, the introduction of monomer vapor can be stopped and the plasma discharge can be stopped at the same time. The reaction chamber can be filled with air or an inert gas to a pressure of 2000-5000 mTorr, and then it can be vacuumized to 10-200 mTorr. Performing at least once of the foregoing steps of inflating and vacuumizing. Air is introduced to an atmospheric pressure, the movement of the substrate is stopped, and then the substrate is taken out.

In a low-vacuum plasma discharge environment, more active free radicals can be formed through effective output of energy and control of chemical bond breaks in monomers with a more active molecular structure, and the excited free radicals and surface active groups of products such as mobile phones initiate polymerization by means of chemical bond bonding to form a nano-waterproof film, and an organosilicon nano-coating is formed on the surface of the substrate. In addition, since the group connected to silicon in the organosilicon monomer has a relatively high activity, it is easier to generate free radicals and undergo cross-linking reaction under low-temperature plasma conditions so as to form dense cross-linked compounds.

In step (A1), the substrate can be moved in the reaction chamber. The substrate can be moved to reciprocate in a linear or a curve manner relative to the reaction chamber, and the curved movement can include a circular movement, an elliptical movement, a planetary movement, a spherical or other movement in irregularly curved paths, etc.

In step (A1), the substrate can be a solid material. The solid material can be an electronic product, an electrical component, a semi-finished electronic assembly, a PCB board, a metal plate, a polytetrafluoroethylene sheet or an electronic component. Any interface of the surface of the substrate can be exposed to and used in water environment, mold environment, acid and alkaline solvent environment, acid and alkaline salt mist environment, acidic atmospheric environment, organic solvent immersion environment, cosmetics environment, sweat environment, cold and hot cycle impact environment or wet heat alternating environment after the preparation of the organosilicon nano-coating.

In step (A1), the reaction chamber can be a rotating chamber or a cubic chamber with a volume of 50-1000 L. The temperature of the reaction chamber can be controlled at 30-60° C., and the flow rate of the inert gas can be 5-300 SCCM.

In step (A2): plasma discharge is performed for chemical vapor deposition, and the plasma discharge process during the deposition process includes low-power continuous discharge, pulse discharge or periodic alternating discharge.

The plasma discharge process during the deposition process can be a low-power continuous discharge, and specifically includes the following deposition processes for at least once.

The deposition process includes a pre-treatment stage and a coating stage. The plasma discharge power in the pre-treatment stage can be 150-600 W, and the continuous discharge time can be 60-450 s. Then, it is the coating stage, and the plasma discharge power can be adjusted to 10-150 W and the continuous discharge time can be 600-3600 s.

The plasma discharge process during the deposition process can be a pulse discharge, and specifically includes the following deposition processes for at least once.

The deposition process includes a pre-treatment stage and a coating stage. The plasma discharge power in the pre-treatment stage can be 150-600 W, and the continuous discharge time can be 60-450 s. Then, it is the coating stage. The coating stage can be a pulse discharge, with the power of 10-300 W and time of 600 s to 3600 s, the pulse discharge frequency is 1-1000 HZ, and the duty cycle of the pulse can be 1:1 to 1:500.

The plasma discharge process during the deposition process can be a periodic alternating discharge, and specifically includes the following deposition processes for at least once.

The deposition process includes a pre-treatment stage and a coating stage. The plasma discharge power in the pre-treatment stage can be 150-600 W, and the continuous discharge time can be 60-450 s. Then, it is the coating stage. During the coating phase, the plasma is periodically alternating discharge output, with the power of 10-300 W, time of 600 s to 3600 s and AC frequency of 1-1000 Hz. The waveform of the plasma periodically alternating discharge output can be a sawtooth waveform, sine waveform, square wave waveform, full-wave rectified waveform, or half-wave rectified waveform.

The organosilicon monomer containing a double bond, Si—Cl, Si—O—C, Si—N—Si, Si—O—Si structure or an annular structure includes:

Organosilicon monomers containing a double bond structure: allyltrimethoxysilane, vinyltriethoxysilane, vinyltrimethylsilane, 3-butenyltrimethylsilane, vinyltris(methylethylketoxime)silane, tetramethyldivinyldisiloxane and 1,2,2-trifluorovinyltriphenylsilane;

Organosilicon monomers containing a Si—Cl structure: triphenylchlorosilane, methylvinyldichlorosilane, trichloro (3,3,3-trifluoropropyl) silane, trifluoropropylmethyldichlorosilane, dimethylphenylchlorosilane, tributylchlorosilane and benzyldimethylchlorosilane;

Organosilicon monomers containing a Si—O—C structure: tetramethoxysilane, trimethoxyhydrosiloxane, n-octyltriethoxysilane, phenyltriethoxysilane, vinyltris (2-methoxythoxy) silane, triethylvinylsilane, hexaethylcyclotrisiloxane, 3-(methacryloyloxy)propyltrimethoxysilane, phenyltris(trimethylsiloxy) silane, diphenyldiethoxysilane, dodecyltrimethoxysilane, n-octyltriethoxysilane, dimethoxysilane and 3-chloropropyltrimethoxysilane;

Organosilicon monomers containing a Si—N—Si or Si—O—Si structure: hexamethyldisilazane, hexamethylcyclotrisilaneamino, hexamethyldisilazane and hexamethyl disiloxane; and Organosilicon monomers containing an annular structure: hexamethylcyclotrisiloxane, octamethylcyclotetrasiloxane, hexaphenylcyclotrisiloxane, decamethylcyclopentasiloxane, octaphenylcyclotetra siloxane, triphenylhydroxysilane, diphenyldihydroxysilane, bis (triphenylsilyl) ester, trifluoropropylmethylcyclotrisiloxane, 2,2,4,4-tetramethyl-6,6,8,8-tetraphenylcyclotetrasiloxane, tetramethyltetravinylcyclotetrasiloxane, (3-glycidyloxypropyl) triethoxysilane and 3-glycidyloxypropyltrimethoxysilane.

The polyfunctional unsaturated hydrocarbons and hydrocarbon derivatives include:

1,3-butadiene, isoprene, 1,4-pentadiene, ethoxylated trimethylolpropane triacrylate, tripropylene glycol diacrylate, polyethylene glycol diacrylate, 1,6-hexanediol diacrylate, ethylene glycol diacrylate, diethylene glycol divinyl ether or neopentyl glycol diacrylate.

In step (A2), the plasma discharge mode can be radio frequency (RF) discharge, microwave discharge, intermediate frequency discharge, high frequency discharge, electric spark discharge, and the waveforms of the high frequency discharge and intermediate frequency discharge are sinusoidal or bipolar pulses. A RF plasma can be a plasma generated by a high-frequency electromagnetic field discharge. In microwave methods, microwave energy can be used to excite the plasma, which has the advantage of high energy utilization efficiency. At the same time, due to electrodeless discharge, the plasma is relative pure. It is an excellent method for high-quality, high-speed and large-area preparation.

During the coating preparation process, the movement characteristics of the substrate and the plasma discharge energy can be linked. At the time of the plasma discharge during the preparation process, the substrate can be moved, which improves the coating deposition efficiency and the uniformity and compactness of the coating thickness.

The prepared coating can be waterproof and moisture proof, mildew resistant, acid and alkaline solvent resistant, acid and alkaline salt spray resistant, acidic atmosphere resistant, organic solvent immersion resistant, cosmetics resistant, sweat resistant, resistant to cold and heat cycle impact (e.g., −40° C. to +100° C.), resistant to humidity and heat change (e.g., 75%-95% of humidity) and has other characteristics. For electronic products (e.g., mobile phones, headphones, smart bracelets, etc.), drones, etc., in addition to the above-mentioned protective properties, in case of a thickness of 1-1000 nm, the effect (e.g., influence or interference) of the coating on the RF communication signals with frequency of 10M-8G is less than 5%, and the coating will not affect the original heat dissipation performance of the electronic products or the requirements of the electronic products for current continuity.

Compared with current art, the above technical solution of the present invention has at least the following advantages:

1. Plasma chemical vapor deposition technology method is more environmentally friendly than the liquid phase conformal coating method. Compared with the parylene evaporative deposition method, the deposition temperature is lower, the speed is faster, the coating structure and composition are strongly controllable, and the monomer selectivity is strong.

2. The substrate moves in the reaction chamber, making the thickness of the substrate coating in different positions tend to be the same, which solves the problem of uneven thickness of the surface coating of the substrate due to the different monomer density in different regions of the reaction chamber. During the preparation process, the movement characteristics of the substrate and the plasma discharge energy are linked. While the discharge energy is output, the substrate moves, which improves the deposition efficiency and significantly improves the compactness of the resulted organosilicon nano-protective coating. At the same time, due to the increased deposition efficiency, the amount of chemical monomer raw materials used for monomer vapor is only 10%-15% of that used in other existing technologies, thereby reducing emission of exhaust gas. It is more environmentally friendly and is of great significance in improving actual production efficiency.

3. In general, a monofunctional carbon/hydrogen/oxygen organic compound monomer is used for plasma polymerization to obtain a coating with a certain cross-linked structure. The cross-linked structure is formed by the cross-linking of a plurality of active sites formed by chain scission of the monomer during plasma discharge. However, this cross-linked structure is relatively loose, contains more linear components, and has poor resistance to solution penetration and solubility.

Compared with traditional monofunctional organic monomers, under plasma conditions, the functional groups connected to silicon in organosilicon monomer can undergo condensation reaction with each other so that a three-dimensional network crosslinking can occur among the monomers so as to further improve the compactness, wear resistance and corrosion resistance of the coating.

(1) Traditional monofunctional carbon/hydrogen/oxygen organic compound monomer containing a double bond, Si—Cl, Si—O—C, Si—N—Si, Si—O—Si structure or an annular structure is used under plasma conditions. Because the functional groups connected to silicon have high reactivity, these organosilicon monomers can have more cross-linkable active sites.

(2) A cross-linked structure is formed by the introduction of other monomer components with a multifunctional cross-linked structure to introduce additional crosslinking points. During plasma discharge, under the action of low-temperature plasma, the active groups with high energy in the monomer component can be interrupted to form active sites through the effective control and output of energy. The introduced additional active sites cross-link and polymerize with each other in a plasma environment to form a dense network structure.

Compared with a coating structure with a large number of loose linear components, the network structure is denser, which can effectively improve the anti-corrosive environment performance of the film. The surface of the coating substrate is activated in the plasma environment to obtain a large number of active sites. These active sites and the active radicals of the monomer material excited by the plasma are combined with each other with strong chemical bonds, and there are various forms of primitive reaction, making the nano-film of the substrate have excellent binding force and mechanical strength. Effective control of the anti-corrosion environment on the substrate surface is achieved by controlling the combination of different monomers and regulating different process conditions at the same time so as to obtain a structure with a special microstructure, a dense bottom layer and a rough surface layer, and its comprehensive resistance to environmental corrosion is increased by 45%-60%. In particular, the hardness of the organosilicon coating of the same thickness is 1-2 grades higher than that of the traditional coating, and the salt spray resistance is increased by 30-50%.

4. By introducing other monomers with cross-linked structure, controlling of the proportion of monomers and giving the equipment corresponding energy output and effective changes in process parameters according to the molecular bond energy, bond length difference and vaporization temperature difference of different monomers, a composite polymer nano-coating with graded structure can be obtained, which not only ensures the hydrophobicity of the film but also improves the environmental corrosion resistance of products such as electronic products and so on.

Electronic equipment in daily life is easily damaged by the corrosion of the corrosive environment. It is basically in the corrosive environment during the use process. After a long time, it will cause irreparable damage to electronic equipment. The coating method of the present invention greatly improves the great significance of nanometer in improving the actual production efficiency. It improves the service life of the coating in corrosive environment and the protection effect of the product. It is mainly used in the following products:

(1) Portable device keyboard: The portable keyboard is small and light, and is often used in computers, mobile phones and other devices. It is convenient for users to work during trip. However, when it encounters contamination of common liquids, such as the accidental overturning of the tea cup, the infiltration of rain and sweat, the keyboard is easily short-circuited and then damaged. After the keyboard is coated with this type of nano-coating, it can ensure that the keyboard surface is easy to clean, and the function is intact after contact with water, so that the keyboard can adapt to more severe environment.

(2) LED display: LED display is used for product promotion, store decoration, lighting, warning and other purposes. Some of its applications are in harsh environment of rain or dust. During rainy days, the outdoor LED advertising screens in shopping malls, LED display control panels in production workshops, road warning lights and LED lamp modules of trademarks, etc. are easy to fail, and dust is easy to be accumulated and it is difficult to clean. After application of this nano-coating, the above problems can be effectively solved.

(3) Intelligent fingerprint lock: Fingerprint lock is a smart lock, which integrates computer information technology, electronic technology, mechanical technology, and modern hardware technology, and is widely used in the public security criminal investigation and judicial fields. However, its internal circuit is easily short-circuited in case of water, it is difficult to repair and requires violent unlocking. This problem can be avoided after using this coating.

(4) Hearing aids, Bluetooth headsets, VR/AR glasses: After this coating is applied, users can use such products in a water environment for a certain period of time, such as bathing, rainy days, and the devices will not be damaged due to rain water. At the same time, after the coating is applied, the product has certain functions of resistance to salt spray and sweat, which can ensure that users can use the product normally even when sweating during exercise.

(5) Sensors: Some sensors need to work in a liquid environment, such as water pressure and oil pressure sensors, sensors used in underwater operating equipment and sensors that often encounter water in the working environment. These sensors will not fail due to the invading of liquid into the internal structure of the mechanical equipment after this coating is applied.

(6) Most 3C products: such as mobile phones, computers, tablet PCs, digital cameras, PSP, etc.

(7) Drone products (agricultural/civilian/police): Drones can encounter different weather conditions during normal work. Corrosive gas environment, rainy and humid environments are inevitable, some pesticide reagents are contacted. Application of this coating to drone products can effectively protect them to ensure that they can be normally used in rainy or even soaked water environment, without the circuit board short-circuiting or flight control failure due to water ingress into the product.

(8) Other equipment that needs to be waterproof: It includes equipment that needs to work in a humid environment, or that may encounter accidents such as common liquid spill, which will affect the normal operation of the internal weak current lines.

The organosilicon nano-coating prepared by this method can also be applied to the following different environments and related products involving:

Waterproof, moisture-proof and mold-proof: such as (1) house interior parts: bathroom ceiling, wallpaper, chandeliers, curtains and window screens; (2) daily necessities: mosquito nets, lampshades, chopstick baskets and car rear-view mirrors; (3) cultural relics and artworks: copybooks, antiques, wood carvings, leather, bronzes, silk, costumes and ancient books; (4) electronic components and electronic products: sensors (operating in wet or dusty environment), chips of various electronic products (electronic blood pressure monitors and smart watches), circuit boards, mobile phones, LED screens and hearing aids. (5) precision instruments and optical equipment: mechanical watches and microscopes; and (6) agricultural/police/civil drones.

Resistance to acid and alkaline solvents, acid and alkaline salt spray and acidic atmosphere: (1) housing interior parts: wallpaper and tiles; (2) protective equipment: acid-resistant (alkali) gloves and acid-resistant (alkali) protective clothing; (3) mechanical equipment and pipelines: flue gas desulfurization equipment, seals (acid/alkaline lubricating oil), pipelines, valves, large-diameter marine transmission pipeline linings, etc.; (4) various reaction kettles and reactors; (5) chemical production and storage; sewage treatment and aeration tanks; and (6) others: acid-alkali workshops, alkali-proof aerospace, energy and power, steel metallurgy, petrochemicals, medical and other industries, storage containers, statues (reducing corrosion of acid rain on them) and sensors (in acid/alkaline environment).

Resistance to organic solvents, cosmetics and sweat: such as (1) paraffins, olefins, alcohols, aldehydes, amines, esters, ethers, ketones, aromatic hydrocarbons, hydrogenated hydrocarbons, terpen hydrocarbons, halogenated hydrocarbons, heterocyclic compounds, solvents containing nitrogen compounds and sulfur compounds; (2) cosmetics packaging container; and (3) fingerprint locks and earphones.

Resistance to cold and heat cycle impact (e.g., −40° C. to +100° C.) and resistance to humidity and heat alternating (e.g., humidity: 75%-95%): electrical, electronic and automotive electrical appliances, such as equipment in the fields of aviation, automotive, home appliances, scientific research and so on.

The present invention is described in detail below with reference to specific embodiments, but the present invention is not limited to the specific embodiments.

Embodiment A1

This embodiment includes a method for preparing an organosilicon nano-protective coating. The method comprises at least (1) a pre-treatment step; (2) a treatment/generation step for organosilicon coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 10 mTorr, an inert gas Ar is introduced, and a movement mechanism is turned on so that the substrate moves in the reaction chamber.

In step (1), the substrate can be a solid material, and the solid material can be a block polytetrafluoroethylene sheet.

In step (1), the reaction chamber can be a rotating chamber with a volume 50 L, the temperature of the reaction chamber can be controlled at 30° C., and the flow rate of the inert gas can be 5 SCCM.

In step (1), the substrate can be moved in the reaction chamber. More particularly, the substrate can be moved in a circular manner relative to the reaction chamber at a speed of 1 rpm.

(2) Preparation of organosilicon coating: A monomer vapor is introduced into the reaction chamber to achieve a vacuum degree of 30 mTorr, the plasma discharge is turned on for chemical vapor deposition, and an organosilicon nano-coating is prepared via chemical vapor deposition on a surface of the substrate.

In some embodiments, the monomer vapor composition can be: a mixture of an organosilicon monomer containing a double bond structure and two polyfunctional unsaturated hydrocarbons or hydrocarbon derivatives, and the mass fraction of the polyfunctional unsaturated hydrocarbons or hydrocarbon derivatives in the monomer vapor is 15%.

In step (2), in some embodiments, the plasma discharge process during the deposition process can be a low-power continuous discharge. The plasma discharge process for chemical vapor deposition specifically can include performing the following deposition processes at least once.

The deposition process can include a pre-treatment stage and a coating stage. The plasma discharge power in the pre-treatment stage can be 150 W, and the continuous discharge time can be 450 s. During the coating stage, the plasma discharge power can be adjusted to 150 W and the continuous discharge time is 600 s.

In step (2), the monomer vapor can be atomized and volatilized through a feeding pump and is then introduced into the reaction chamber at a low pressure of 10 mTorr. The flow rate of the introduced monomer vapor can be 1000 μL/min.

In some embodiments, the organosilicon monomer containing a double bond structure can be vinyltriethoxysilane. In some embodiments, the two polyfunctional unsaturated hydrocarbons and hydrocarbon derivatives can be: 1,3-butadiene and ethylene glycol diacrylate. In some embodiments, the plasma discharge mode in step (2) can be a radio frequency discharge.

(3) Post-treatment: The monomer vapor is stopped being introduced, the plasma discharge is stopped at the same time, and vacuumizing is continued. The vacuum degree of the reaction chamber can be kept to 10 mTorr for 1 min. Then air is introduced to an atmospheric pressure, the movement of the substrate is stopped, and then the substrate is taken out.

By the foregoing steps, a polytetrafluoroethylene (PTFE) board deposited with an organosilicon nano-coating can be obtained. The PTFE board has been tested for mold resistance according to GJB150.10A-2009 standard, and the test result is shown in the following table.

PTFE board-performance test

| Thickness | Water contact angle | Oil contact angle | Adhesion | Mold resistance grade | Degree of surface mold spots |
|---|---|---|---|---|---|
| 356 nm | 113° | 58° | Low adhesion and water droplets are easy to slide. | Grade 2 | 3% |
| 347 nm | 1110 | 56° | | Grade 2 | 3% |
| 351 nm | 109° | 46° | | Grade 2 | 3% |

Embodiment A2

This embodiment includes a method for preparing an organosilicon nano-protective coating. The method comprises at least (1) a pre-treatment step; (2) a treatment step for organosilicon coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 60 mTorr, an inert gas He is introduced, and a movement mechanism is turned on so that the substrate moves.

In step (1), the substrate can be a solid material, and the solid material can be a block of aluminum alloy anodized material.

In step (1), the reaction chamber can be a cubic chamber with a volume 250 L, the temperature of the reaction chamber can be controlled at 40° C., and the flow rate of the inert gas can be 15 SCCM.

In step (1), the substrate can perform planetary movement at a revolution speed of 1 rpm and a rotation speed of 1.5 rpm.

(2) Preparation of organosilicon coating: A monomer vapor is introduced into the reaction chamber to achieve a vacuum degree of 110 mTorr, the plasma discharge is turned on for chemical vapor deposition, and an organosilicon nano-coating is prepared via chemical vapor deposition on a surface of the substrate.

The monomer vapor composition can be: a mixture of two organosilicon monomers containing a Si—Cl structure and three polyfunctional unsaturated hydrocarbons or hydrocarbon derivatives, and the mass fraction of the polyfunctional unsaturated hydrocarbons or hydrocarbon derivatives in the monomer vapor is 29%.

In step (2), a plasma discharge process for chemical vapor deposition is performed. The plasma discharge process during the deposition process can be a low-power continuous discharge, and specifically includes the following deposition processes for at least three times.

The deposition process includes a pre-treatment stage and a coating stage. The plasma discharge power in the pre-treatment stage is 600 W, and the continuous discharge time is 60 s. Then, during the coating stage, and the plasma discharge power is adjusted to 10 W and the continuous discharge time is 3600 s.

In step (2), the monomer vapor is atomized and volatilized through a feeding pump and is then introduced into the reaction chamber at a low pressure of 60 mTorr, and the flow rate of the introduced monomer vapor is 700 μL/min.

In some embodiments, the two organosilicon monomers containing a Si—Cl structure can be triphenylchlorosilane and trifluoropropylmethyldichlorosilane.

The three polyfunctional unsaturated hydrocarbons and hydrocarbon derivatives can be 1,4-pentadiene, tripropylene glycol diacrylate, and polyethylene glycol diacrylate.

The plasma discharge mode in step (2) can be an intermediate-frequency discharge.

(3) Post-treatment: The monomer vapor is stopped being introduced, the plasma discharge is stopped at the same time, vacuumizing is continued, the vacuum degree of the reaction chamber is kept to 80 mTorr for 2 min, then air is introduced to an atmospheric pressure, and then the substrate is taken out.

After the organosilicon coating is prepared on the surface of the above-mentioned block of aluminum alloy anodized material, it is tested for acid and alkali resistance in acid and alkali test environments. The test result and effects are shown in the following table.

| Material | Acid and alkaline reagent | Time 96 h | 160 h | 224 h | 288 h |
|---|---|---|---|---|---|
| Block aluminum alloy anodized material | Acid salt spray | pass | pass | pass | pass |
| | Neutral salt spray | pass | pass | pass | pass |
| | Alkaline salt spray | pass | pass | pass | pass |
| | 5% acetic acid solution | pass | pass | pass | pass |
| | 5% NaOH solution | pass | pass | pass | pass |

Embodiment A3

This embodiment includes a method for preparing an organosilicon nano-protective coating. The method comprises at least (1) a pre-treatment step; (2) a treatment step for organosilicon coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 130 mTorr, a mixture of inert gas Ar and He is introduced, and a movement mechanism is turned on so that the substrate moves.

In step (1), the substrate can be a solid material, and the solid material can be a block alloy steel plate material and/or a PC plastic plate.

In step (1), the reaction chamber can be a rotating chamber with a volume 480 L, the temperature of the reaction chamber can be controlled at 50° C., and the flow rate of the inert gas can be 60 SCCM.

In step (1), the substrate can perform a circular movement at a speed of 3 rpm.

(2) Preparation of organosilicon coating: A monomer vapor is introduced into the reaction chamber to achieve a vacuum degree of 170 mTorr, the plasma discharge is turned on for chemical vapor deposition, and an organosilicon nano-coating is prepared/generated via chemical vapor deposition on a surface of the substrate.

The monomer vapor composition can be: a mixture of three organosilicon monomers containing a Si—O—C structure and one polyfunctional unsaturated hydrocarbon or hydrocarbon derivative, and the mass fraction of the polyfunctional unsaturated hydrocarbons or hydrocarbon derivatives in the monomer vapor is 42%.

A plasma discharge process can be performed for chemical vapor deposition. The plasma discharge process during the deposition process can be a pulse discharge, and specifically can include the following deposition processes for three times.

The deposition process includes a pre-treatment stage and a coating stage. The plasma discharge power in the pre-treatment stage is 150 W, and the continuous discharge time is 450 s. Then, it is the coating stage. During the coating stage, a pulse discharge can be performed, with the power of 300 W and time of 600 s. The pulse discharge frequency can be 1 HZ, and the duty cycle of the pulse can be 1:1.

In step (2), the monomer vapor can be atomized and volatilized through a feeding pump and is then introduced into the reaction chamber at a low pressure of 130 mTorr, and the flow rate of the introduced monomer vapor is 550 μL/min.

The three organosilicon monomers containing a Si—O—C structure can be phenyltriethoxysilane, triethylvinylsilane and hexaethylcyclotrisiloxane. The polyfunctional unsaturated hydrocarbon derivative can be 1,6-hexanediol diacrylate.

The plasma discharge mode in step (2) is high-frequency discharge, and the waveform of the high-frequency discharge is a bipolar pulse.

(3) Post-treatment: The monomer vapor is stopped being introduced, the plasma discharge is stopped at the same time, and vacuumizing is continued. The vacuum degree of the reaction chamber is kept to 160 mTorr for 3 min, then air is introduced to an atmospheric pressure, and then the substrate is taken out.

After deposited with an organosilicon coating, the above-mentioned alloy steel plate material and PC plastic plate are immersed in an organic solvent to test their resistance to organic solvents and the test result and effects are as follows:

| Substrate | Chemical reagent | Time 96 h | 160 h | 224 h | 288 h |
|---|---|---|---|---|---|
| Block alloy steel plate material | Acetone | pass | pass | pass | pass |
| | Cyclohexane | pass | pass | pass | pass |
| | Petroleum ether | pass | pass | pass | pass |
| | Xylene | pass | pass | pass | pass |
| | n-propanol | pass | pass | pass | pass |
| PC plastic plate | Acetone | pass | pass | pass | pass |
| | Cyclohexane | pass | pass | pass | pass |
| | Petroleum ether | pass | pass | pass | pass |
| | Xylene | pass | pass | pass | pass |
| | n-propanol | pass | pass | pass | pass |

Embodiment A4

This embodiment includes a method for preparing an organosilicon nano-protective coating. The method comprises at least (1) a pre-treatment step; (2) a treatment step for organosilicon coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 160 mTorr, an inert gas He is introduced, and a movement mechanism is turned on so that the substrate moves.

In step (1), the substrate can be a solid material, and the solid material can be a block of aluminum material and a PCB board.

In step (1), the volume of the reaction chamber can be 680 L, the temperature of the reaction chamber can be controlled at 50° C., and the flow rate of the inert gas can be 160 SCCM.

In step (1), the substrate linearly can be moved to reciprocate at a movement speed of 20 mm/min.

(2) Preparation of organosilicon coating: A monomer vapor is introduced into the reaction chamber to achieve a vacuum degree of 210 mTorr, the plasma discharge is turned on for chemical vapor deposition, and an organosilicon nano-coating is prepared via chemical vapor deposition on a surface of the substrate.

The monomer vapor composition can be: a mixture of two organosilicon monomers containing Si—N—Si or Si—O—Si structure and four polyfunctional unsaturated hydrocarbons or hydrocarbon derivatives, and the mass fraction of the polyfunctional unsaturated hydrocarbons or hydrocarbon derivatives in the monomer vapor is 65%.

A plasma discharge process can be formed for chemical vapor deposition. The plasma discharge process during the deposition process can be a pulse discharge, and specifically can include the following deposition processes for at least once:

The deposition process includes a pre-treatment stage and a coating stage. The plasma discharge power in the pre-treatment stage is 600 W, and the continuous discharge time is 60 s. Then, it is the coating stage. During the coating stage, a pulse discharge can be performed, with the power of 10 W and time of 3600 s. The pulse discharge frequency can be 1000 HZ, and the duty cycle of the pulse can be 1:500.

In step (2), the monomer vapor can be atomized and volatilized through a feeding pump and can be then introduced into the reaction chamber at a low pressure of 160 mTorr, and the flow rate of the introduced monomer vapor can be 220 μL/min.

The two organosilicon monomers containing a Si—N—Si or Si—O—Si structure can be hexamethylcyclotrisilaneamino and hexamethyldisilazane. The four polyfunctional unsaturated hydrocarbons and hydrocarbon derivatives can be: isoprene, ethoxylated trimethylolpropane triacrylate, tripropylene glycol diacrylate and polyethylene glycol diacrylate.

The plasma discharge mode in step (2) can be a microwave discharge.

(3) Post-treatment: The monomer vapor is stopped being introduced, the plasma discharge is stopped at the same time, vacuumizing is continued, the vacuum degree of the reaction chamber is kept to 200 mTorr for 5 min, then air is introduced to an atmospheric pressure, and then the substrate is taken out.

The above-mentioned coated aluminum materials and PCB boards are subjected to cold and hot cycle impact test by being exposed to cold and hot cycle test environment, and the test results are as follows:

| Test substrate | Experimental conditions | Times of cycle | Experiment time | Result detection |
|---|---|---|---|---|
| Block aluminum material | −40° C.~+100° C. | 50 | 5 h | Good appearance without affecting performance |
| PCB board | −40° C.~+100° C. | 50 | 5 h | Good appearance without affecting performance |

Embodiment A5

This embodiment includes a method for preparing an organosilicon nano-protective coating. The method comprises at least (1) a pre-treatment step; (2) a treatment step for organosilicon coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 200 mTorr, an inert gas Ar is introduced, and a movement mechanism is turned on so that the substrate moves.

In step (1), the substrate can be a solid material, and the solid material can be an electronic component.

In step (1), the volume of the reaction chamber can be 1000 L, the temperature of the reaction chamber can be controlled at 60° C., and the flow rate of the inert gas can be 300 SCCM.

In step (1), the substrate can be moved to reciprocate in a curve manner at a speed of 100 mm/min.

(2) Preparation of organosilicon coating: A monomer vapor is introduced into the reaction chamber to achieve a vacuum degree of 300 mTorr, the plasma discharge is turned on for chemical vapor deposition, and an organosilicon nano-coating is prepared via chemical vapor deposition on a surface of the substrate;

The monomer vapor composition can be: a mixture of three organosilicon monomers containing an annular structure and five polyfunctional unsaturated hydrocarbons or hydrocarbon derivatives, wherein the mass fraction of the polyfunctional unsaturated hydrocarbons or hydrocarbon derivatives in the monomer vapor is 52%.

A plasma discharge can be performed for chemical vapor deposition. The plasma discharge process during the deposition process can be a periodic alternating discharge, and specifically can include the following deposition processes for four times.

The deposition process can include a pre-treatment stage and a coating stage. The plasma discharge power in the pre-treatment stage is 150 W, and the continuous discharge time can be 450 s. Then, it is the coating stage. During the coating phase, the plasma is periodically alternating discharge output, with the power of 300 W, time of 600 s and AC frequency of 1 Hz. The waveform of the plasma periodically alternating discharge output is a sawtooth waveform.

In step (2), the monomer vapor can be atomized and volatilized through a feeding pump and can be then introduced into the reaction chamber at a low pressure of 200 mTorr, and the flow rate of the introduced monomer vapor can be 10 μL/min.

The three organosilicon monomers containing an annular structure can be octaphenylcyclotetra siloxane, bis(triphenylsilyl) ester and tetramethyltetravinylcyclotetrasiloxane. The five polyfunctional unsaturated hydrocarbon derivatives can be: 1,4-pentadiene, tripropylene glycol diacrylate, polyethylene glycol diacrylate, ethylene glycol diacrylate and diethylene glycol divinyl ether.

The plasma discharge mode in step (2) can be an electric spark discharge.

(3) Post-treatment: The introduction of monomer vapor is stopped and the plasma discharge is stopped at the same time, the reaction chamber is filled with an inert gas to a pressure of 2000 mTorr, and then it is vacuumized to 10 mTorr, the above steps of inflating and vacuumizing are performed once, air is introduced to an atmospheric pressure, the movement of the substrate is stopped, and then the substrate is taken out. The above-mentioned coated electronic components are exposed to the humid heat test environment to test their humid heat resistance property, and the test results are as follows:

| Test substrate | Test conditions and results | | | | | | |
|---|---|---|---|---|---|---|---|
| Electronic Components | Temperature | | 55° C. | | | | |
| | Humidity | | 75 | 80 | 85 | 90 | 95 |
| | Time | 48 h | Pass | Pass | Pass | Pass | Pass |
| | Time | 96 h | Pass | Pass | Pass | Pass | Pass |
| | Time | 144 h | Pass | Pass | Pass | Pass | Pass |
| | Time | 192 h | Pass | Pass | Pass | Pass | Pass |

Embodiment A6

This embodiment includes a method for preparing an organosilicon nano-protective coating. The method comprises at least (1) a pre-treatment step; (2) a treatment step for organosilicon coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 180 mTorr, an inert gas Ar is introduced, and a movement mechanism is turned on so that the substrate moves.

In step (1), the substrate can be a solid material, and the solid material can be an electrical component.

In step (1), the volume of the reaction chamber can be 880 L, the temperature of the reaction chamber can be controlled at 50° C., and the flow rate of the inert gas can be 200 SCCM.

In step (1), the substrate can be moved to reciprocate in a curve manner at a speed of 200 mm/min.

(2) Preparation of organosilicon coating: A monomer vapor is introduced into the reaction chamber to achieve a vacuum degree of 250 mTorr, the plasma discharge is turned on for chemical vapor deposition, and an organosilicon nano-coating is prepared via chemical vapor deposition on a surface of the substrate;

The monomer vapor composition can be: a mixture of four organosilicon monomers containing a Si—O—C structure and three polyfunctional unsaturated hydrocarbons or hydrocarbon derivatives, wherein the mass fraction of the polyfunctional unsaturated hydrocarbons or hydrocarbon derivatives in the monomer vapor is 57%.

A plasma discharge process can be performed for chemical vapor deposition. The plasma discharge process during the deposition process can be a periodic alternating discharge, and specifically can include the following deposition processes for once:

The deposition process includes a pre-treatment stage and a coating stage. The plasma discharge power in the pretreatment stage is 600 W, and the continuous discharge time can be 60 s. Then, it is the coating stage. During the coating phase, the plasma can be periodically alternating discharge output, with the power of 10 W, time of 3600 s and AC frequency of 1000 Hz. The waveform of the plasma periodically alternating discharge output is a full-wave rectified waveform.

In step (2), the monomer vapor can be atomized and volatilized through a feeding pump and can be then introduced into the reaction chamber at a low pressure of 180 mTorr, and the flow rate of the introduced monomer vapor can be 35 μL/min.

The four organosilicon monomers containing a Si—O—C structure can be hexaethylcyclotrisiloxane, diphenyldiethoxysilane, dodecyltrimethoxysilane and 3-chloropropyltrimethoxysilane. The three polyfunctional unsaturated hydrocarbon derivatives can be polyethylene glycol diacrylate, ethylene glycol diacrylate and Neopentyl glycol diacrylate.

The plasma discharge mode in step (2) can be an intermediate-frequency discharge, and the waveform of the intermediate-frequency discharge can be sinusoidal.

(3) Post-treatment: The introduction of monomer vapor is stopped and the plasma discharge is stopped at the same time, the reaction chamber is filled with air to a pressure of 5000 mTorr, and then it is vacuumized to 200 mTorr, the above steps of inflating and vacuumizing are performed for 12 times, air is introduced to an atmospheric pressure, the movement of the substrate is stopped, and then the substrate is taken out. The above-mentioned coated electrical components are tested for resistance to underwater electricity and immersion under the environment described in the international industrial waterproofing standard IPX7, and the experimental results are as follows. The following table is the test result of the time for the coating prepared in the present embodiment to enable the current to reach 1 mA at different voltages:

| Voltage | 3.8 V | 5 V | 12.5 V |
|---|---|---|---|
| Time | >48 h | >48 h | >48 h |

The obtained IPX 7 waterproof rating test result (1-meter underwater immersion test for 30 minutes) of the electrical component with the deposited waterproof and electrical breakdown resistant coating is as follows:

| IPX7 waterproof grade test | |
|---|---|
| Times of Test | Test results |
| 1 | Electrical components work properly. |
| 3 | Electrical components work properly. |
| 5 | Electrical components work properly. |

Hardened Nano-Protective Coating—Embodiments B1-B6

The present invention also provides methods for preparing a hardened or hard nano-protective coating. More particularly, the present method can generate an organosilicon hard nano-protective coating.

As discussed above, the present invention replaces traditional organic compound monomers with organosilicon monomers. In some embodiments, oxygen can be introduced into the monomer, so that the oxygen reacts with the organosilicon monomer. When the oxygen completely replaces the carbon in the silicon atom, the organic silicon can be oxidized to nano-silica. In some embodiments, when water vapor is introduced into the monomer, it can be hydrolyzed with organic silicon to produce nano-silica. The mass percentage of the obtained nano-silica is about 5%-20%. Since silica is an atomic crystal, the hardness is as high as 1500 HV. It is dispersed in the coating so that the hardness of the coating can be greatly improved due to the dispersion strengthening effect. The organic coating obtained by plasma deposition usually has a hardness of HB-2H. When the mass percentage of silica in the coating is 5%, the hardness of the coating can be increased to H-3H. When the mass percentage of silica in the coating is 20%, coating hardness can be increased to 2H-4H.

The technical solution adopted by the present invention is as follows: a preparation method for organosilicon hard nano-protective coating, comprising the following steps:

(B1) Pre-Treatment:

A substrate is placed in a reaction chamber of a nano-coating preparation equipment. The reaction chamber is continuously vacuumized. The vacuum degree within the reaction chamber is adjusted to 10 to 200 mTorr. An inert gas He, Ar or a mixture of He and Ar is introduced, and a movement mechanism is turned on so that the substrate moves in the reaction chamber.

(B2) Preparation of Organosilicon Coating:

A monomer vapor is introduced into the reaction chamber to achieve a vacuum degree of 30-300 mTorr. Plasma discharge is turned on for chemical vapor deposition, and an organosilicon nano-coating is prepared via chemical vapor deposition on a surface of the substrate.

In some embodiments, the monomer vapor composition comprises: a mixture of (i) at least one organosilicon monomer containing a double bond, Si—Cl, Si—O—C, Si—N—Si, Si—O—Si structure or an annular structure and (ii) at least one polyfunctional unsaturated hydrocarbon or hydrocarbon derivative. The mass fraction of the polyfunctional unsaturated hydrocarbon or hydrocarbon derivative in the monomer vapor is 15-65%.

The monomer vapor is atomized and volatilized through a feeding pump and is then introduced into the reaction chamber at a low pressure of 10-200 mTorr. The flow rate of the introduced monomer is 10-1000 μL/min.

(B3) Surface Hardening:

The introduction of the monomer vapor is stopped. Oxygen and/or water vapor is introduced at a flow rate of 10-1000 μL/min. The oxygen and water vapor can be mixed at any suitable ratio. The plasma discharge power is 50-100 W, and the continuous discharge time is 60-180 s. The surface of the organosilicon nano-coating is hardened.

(B4) Post-Treatment:

The process stops introducing the oxygen and/or water vapor at this step. The plasma discharge is stopped (or turned off) at the same time. Vacuumizing is continued, and the vacuum degree of the reaction chamber is kept as 10-200 mTorr for 1-5 minutes. Then air is introduced until the pressure of the reaction chamber reaches an atmospheric pressure. The movement of the substrate is stopped and then the substrate is taken out.

Alternatively, in some embodiments, the introduction of the oxygen and/or water vapor can be stopped and the plasma discharge is stopped at the same time. The reaction chamber can be filled with air or an inert gas at a pressure of 2000-5000 mTorr, and then it is vacuumized to 10-200 mTorr. The foregoing steps of inflating and vacuumizing are performed at least once. Air is then introduced until the pressure of the reaction chamber reaches an atmospheric pressure. The movement of the substrate is stopped, and then the substrate is taken out.

In step (B1), the substrate is moved in the reaction chamber. The substrate can be moved to reciprocate in a linear or a curve manner relative to the reaction chamber. The curve manner corresponds to a circular movement, an elliptical movement, a planetary movement, a spherical or other movement in irregularly curved paths, etc.

In step (B1), the substrate can be a solid material. The solid material can be an electronic product, an electrical component, a semi-finished electronic assembly, a PCB board, a metal plate, a polytetrafluoroethylene sheet or an electronic component, and any interface of the surface of the substrate can be exposed to and used in water environment, mold environment, acid and alkaline solvent environment, acid and alkaline salt mist environment, acidic atmospheric environment, organic solvent immersion environment, cosmetics environment, sweat environment, cold and hot cycle impact environment or wet heat alternating environment after the preparation of the organosilicon nano-coating.

In step (B1), the reaction chamber can be a rotating chamber or a cubic chamber with a volume of 50-1000 L. The temperature of the reaction chamber can be controlled at 30-60° C., and the flow rate of the inert gas can be 5-300 SCCM.

In step (B2), plasma discharge is performed for chemical vapor deposition, and the plasma discharge process during the deposition process includes low-power continuous discharge, pulse discharge or periodic alternating discharge.

The plasma discharge process during the deposition process is a low-power continuous discharge, and specifically includes the following deposition processes for at least once.

The deposition process includes a pre-treatment stage and a coating stage. The plasma discharge power in the pre-treatment stage can be 150-600 W, and the continuous discharge time can be 60-450 s. Then, it is the coating stage, and the plasma discharge power can be adjusted to 10-150 W and the continuous discharge time is 600-3600 s.

The plasma discharge process during the deposition process can be a pulse discharge, and specifically includes the following deposition processes for at least once.

The deposition process includes a pre-treatment stage and a coating stage. The plasma discharge power in the pre-treatment stage can be 150-600 W, and the continuous discharge time can be 60-450 s. Then, in the coating stage, a pulse discharge process is performed, with the power of 10-300 W and time of 600 s to 3600 s. The pulse discharge frequency can be 1-1000 HZ, and the duty cycle of the pulse can be 1:1-1:500.

The plasma discharge process during the deposition process can be a periodic alternating discharge, and specifically includes the following deposition processes for at least once.

The deposition process includes a pre-treatment stage and a coating stage. The plasma discharge power in the pre-treatment stage can be 150-600 W, and the continuous discharge time can be 60-450 s. Then, during coating stage, the plasma can be periodically alternating discharge output, with the power of 10-300 W, time of 600 s to 3600 s and AC frequency of 1-1000 Hz. The waveform of the plasma periodically alternating discharge output can be a sawtooth waveform, sine waveform, square wave waveform, full-wave rectified waveform, or half-wave rectified waveform.

The organosilicon monomer containing a double bond, Si—Cl, Si—O—C, Si—N—Si, Si—O—Si structure or an annular structure includes:

Organosilicon monomers containing a double bond structure: allyltrimethoxysilane, vinyltriethoxysilane, vinyltrimethylsilane, 3-butenyltrimethylsilane, Vinyltris(methylethylketoxime)silane, tetramethyldivinyldisiloxane, and 1,2,2-trifluorovinyltriphenylsilane.

Organosilicon monomers containing a Si—Cl structure: triphenylchlorosilane, methylvinyldichlorosilane, trichloro(3,3,3-trifluoropropyl)silane, trifluoropropylmethyldichlorosilane, dimethylphenylchlorosilane, tributylchlorosilane and benzyldimethylchlorosilane.

Organosilicon monomers containing a Si—O—C structure: tetramethoxysilane, trimethoxyhydrosiloxane, n-octyltriethoxysilane, phenyltriethoxysilane, vinyltris(2-methoxythoxy) silane, triethylvinylsilane, hexaethylcyclotrisiloxane, 3-(methacryloyloxy) propyltrimethoxysilane, phenyltris(trimethylsiloxy)silane, diphenyldiethoxysilane, dodecyltrimethoxysilane, n-octyltriethoxysilane, dimethoxysilane and 3-chloropropyltrimethoxysilane.

Organosilicon monomers containing a Si—N—Si or Si—O—Si structure: hexamethyldisilazane, hexamethylcyclotrisilaneamino, hexamethyldisilazane, and hexamethyl disiloxane.

Organosilicon monomers containing an annular structure: hexamethylcyclotrisiloxane, octamethylcyclotetrasiloxane, hexaphenylcyclotrisiloxane, decamethylcyclopentasiloxane, octaphenylcyclotetra siloxane, triphenylhydroxysilane, diphenyldihydroxysilane, bis(triphenylsilyl) ester, trifluoropropylmethylcyclotrisiloxane, 2,2,4,4-tetramethyl-6,6,8,8-tetraphenylcyclotetrasiloxane, tetramethyltetravinylcyclotetrasiloxane, (3-glycidyloxypropyl) triethoxysilane, and 3-glycidyloxypropyltrimethoxysilane.

The polyfunctional unsaturated hydrocarbons and hydrocarbon derivatives can include: 1,3-butadiene, isoprene, 1,4-pentadiene, ethoxylated trimethylolpropane triacrylate, tripropylene glycol diacrylate, polyethylene glycol diacrylate, 1,6-hexanediol diacrylate, ethylene glycol diacrylate, diethylene glycol divinyl ether or neopentyl glycol diacrylate.

In step (B2) and step (B3), the plasma discharge mode can be radio frequency discharge, microwave discharge, intermediate frequency discharge, high frequency discharge, electric spark discharge, etc. The waveforms of the high frequency discharge and intermediate frequency discharge can be sinusoidal or bipolar pulses. RF plasma can be a plasma generated by discharge of a high-frequency electromagnetic field. In microwave methods, microwave energy can be used to excite the plasma, which has the advantage of high energy utilization efficiency. At the same time, because of electrodeless discharge, the plasma is relative pure. It is an excellent method for high-quality, high-speed and large-area preparation.

During the coating preparation process, the movement characteristics of the substrate and the plasma discharge energy can be linked. At the time of the plasma discharge during the preparation process, the substrate is moved moves, which improves the coating deposition efficiency and the uniformity and compactness of the coating thickness.

The prepared coating has good abrasion resistance, and is waterproof and moisture resistant, mold resistant, acid and alkaline solvent resistant, acid and alkaline salt spray resistant, acidic atmosphere resistant, organic solvent immersion resistant, cosmetics resistant, sweat resistant, resistant to cold and heat cycle impact (e.g., −40° C. to +75° C.), resistant to humidity and heat change (e.g., 75%-95% of humidity) and has other characteristics.

In addition to the above-mentioned protective properties, in the embodiment where a thickness of the coating is 1-1000 nm, the effect (e.g., influence or interference) of the coating on the RF communication signals with frequency of 10M-8G is less than 5%.

Compared with the current art, the above technical solution of the present invention has the following advantages:

1. Plasma chemical vapor deposition technology method is more environmentally friendly than the liquid phase conformal coating method. Compared with the parylene evaporative deposition method, the deposition temperature is lower, the speed is faster, the coating structure and composition are strongly controllable, and the monomer selectivity is strong.

2. The substrate moves in the reaction chamber, making the thickness of the substrate coating in different positions tend to be the same, which solves the problem of uneven thickness of the surface coating of the substrate due to the different monomer density in different regions of the reaction chamber. During the preparation process, the movement characteristics of the substrate and the plasma discharge energy are linked. While the discharge energy is output, the substrate moves, which improves the deposition efficiency and significantly improves the compactness of the resulted organosilicon nano-protective coating. At the same time, due to the increased deposition efficiency, the amount of chemical monomer raw materials used for monomer vapor is only 10%-15% of that used in other existing technologies, thereby reducing emission of exhaust gas. It is more environmentally friendly and is of great significance in improving actual production efficiency.

3. In general, a monofunctional carbon/hydrogen/oxygen organic compound monomer is used for plasma polymerization to obtain a coating with a certain cross-linked structure. The cross-linked structure is formed by the cross-linking of a plurality of active sites formed by chain scission of the monomer during plasma discharge. However, this crosslinked structure is relatively loose, contains more linear components, and has poor resistance to solution penetration and solubility.

Compared with traditional monofunctional organic monomers, under plasma conditions, the functional groups connected to silicon in organosilicon monomer can undergo condensation reaction with each other so that a three-dimensional network crosslinking can occur among the monomers so as to further improve the compactness, wear resistance and corrosion resistance of the coating.

(1) The traditional monofunctional carbon/hydrogen/oxygen organic compound monomer containing a double bond, Si—Cl, Si—O—C, Si—N—Si, Si—O—Si structure or an annular structure is used under plasma conditions. Because the functional groups connected to silicon have high reactivity, these organosilicon monomers have more cross-linkable active sites.

(2) A crosslinked structure is formed by the introduction of other monomer components with a multifunctional cross-linked structure to introduce additional crosslinking points. During plasma discharge, under the action of low-temperature plasma, the active groups with high energy in the monomer component are interrupted to form active sites through the effective control and output of energy. The introduced additional active sites cross-link and polymerize with each other in a plasma environment to form a dense network structure.

Compared with a coating structure with a large number of loose linear components, the network structure is denser, which can effectively improve the abrasion and corrosion resistance of the film. The surface of the coating substrate is activated in the plasma environment to obtain a large number of active sites. These active sites and the active radicals of the monomer material excited by the plasma are combined with each other with strong chemical bonds, and there are various forms of primitive reaction, making the nano-film of the substrate have excellent binding force and mechanical strength. Effective control of the anti-corrosion environment on the substrate surface is achieved by controlling the combination of different monomers and regulating different process conditions at the same time so as to obtain a structure with a special microstructure, a dense bottom layer and a rough surface layer, and its comprehensive resistance to environmental corrosion is increased by 20%-35%, and hardness can reach 2H-4H.

4. The present invention utilizes plasma chemical vapor deposition to control a monomer and a coating structure to obtain a protective coating with excellent performance. This coating has the following advantages: the thickness can be controlled between 20 nm and 10 μm, and the hardness can be controlled between 2H-4H. At the same time, the protective coating has excellent insulation performance, and resistance to water and electrification underwater. As a result, the protective coating has an excellent "three-proof" ability (e.g., Mold-proof, moisture-proof and salt spray proof).

5. Since the group connected to silicon in the organosilicon monomer has relatively high activity, it is easier to generate free radicals and undergo cross-linking reaction under low-temperature plasma conditions so as to form dense cross-linked compounds; the introduction of oxygen can generate a high-hardness nano-silica phase in the coating, which effectively improves the hardness of the coating. After the hardening treatment, an organosilicon series coating can have a hardness of 2H-4H, which can effectively improve the wear resistance and extend the service life of the coating.

By introducing other monomers with cross-linked structure, controlling of the proportion of monomers and giving the equipment corresponding energy output and effective changes in process parameters according to the molecular bond energy, bond length difference and vaporization temperature difference of different monomers, a composite polymer nano-coating with graded structure can be obtained, which not only guarantees the hydrophobicity of the film but also improves the corrosion resistance and abrasion resistance of electronic products and other products. When the mass percentage of silica in the coating is 20%, the abrasion resistance is increased by 2-3 times than that of a silica-free coating.

Electronic equipment in daily life is easily damaged by the corrosion of the corrosive environment. It is basically in the corrosive environment during the use process. After a long time, it will cause irreparable damage to electronic equipment. Generally, traditional plasma coating (e.g., with hardness HB-2H) has poor abrasion resistance and a relatively short service life. The coating method of the present invention greatly improves the great significance of nanometer in improving the actual production efficiency. The hardness of the coating is increased by more than 2 times, and the service life in the corrosive and accessible environment is increased by 4-6 times, which effectively improves the protection effect of the product. The present coating can be used in the following products:

(1) Portable device keyboard: The portable keyboard is small and light, and is often used in computers, mobile phones and other devices. It is convenient for users to work during trip. However, when it encounters contamination of common liquids, such as the accidental overturning of the tea cup, the infiltration of rain and sweat, the keyboard is easily short-circuited and then damaged. After the keyboard is coated with this type of nano-coating, it can ensure that the keyboard surface is easy to clean, and the function is intact after contact with water, so that the keyboard can adapt to more severe environment.

(2) LED display: LED display is used for product promotion, store decoration, lighting, warning and other purposes. Some of its applications are in harsh environment of rain or dust. During rainy days, the outdoor LED advertising screens in shopping malls, road warning lights and LED display control panels in production workshops, etc. are easy to fail, and dust is easy to be accumulated and it is difficult to clean. After application of this nano-coating, the above problems can be effectively solved.

(3) Intelligent fingerprint lock: Fingerprint lock is a smart lock, which integrates computer information technology, electronic technology, mechanical technology and modern hardware technology, and is widely used in the public security criminal investigation and judicial fields. However, its internal circuit is easily short-circuited in case of water, it is difficult to repair and requires violent unlocking. This problem can be avoided after using this coating.

(4) Hearing aids and Bluetooth headsets: There are no communication cables for hearing aids or Bluetooth headsets. After this coating is applied, users can use such products in a water environment for a certain period of time, such as bathing, rainy days, and the devices will not be damaged due to rain water.

(5) Sensors: Some sensors need to work in a liquid environment, such as water pressure and oil pressure sensors, sensors used in underwater operating equipment and sensors that often encounter water in the working environment. These sensors will not fail due to the invading of liquid into the internal structure of the mechanical equipment after this coating is applied.

(6) 3C products: such as mobile phones, notebooks, PSP, etc.

(7) Other equipment that needs to be waterproof: It includes equipment that needs to work in a humid environment, or that may encounter accidents such as common liquid spill, which will affect the normal operation of the internal weak current lines.

The organosilicon nano-coating prepared by this method can also be applied to the following different environments and related products involving:

Waterproof, moisture-proof and mold-proof: such as (1) house interior parts: bathroom ceiling, wallpaper, chandeliers, curtains and window screens; (2) daily necessities: mosquito nets, lampshades, chopstick baskets and car rear-view mirrors; (3) cultural relics and artworks: copybooks, antiques, wood carvings, leather, bronzes, silk, costumes and ancient books; (4) electronic components and electronic products: sensors (operating in wet or dusty environment), chips of various electronic products (electronic blood pressure monitors and smart watches), circuit boards, mobile phones, LED screens and hearing aids; (5) precision instruments and optical equipment: mechanical watches and microscopes.

Resistance to acid and alkaline solvents, acid and alkaline salt spray and acidic atmosphere: such as (1) housing interior parts: wallpaper and tiles; (2) protective equipment: acid-resistant (alkali) gloves and acid-resistant (alkali) protective clothing; (3) mechanical equipment and pipelines: flue gas desulfurization equipment, seals (acid/alkaline lubricating oil), pipelines, valves, large-diameter marine transmission pipeline linings, etc.; (4) various reaction kettles and reactors; (5) chemical production and storage; sewage treatment and aeration tanks; (6) others: acid-alkali workshops, alkali-proof aerospace, energy and power, steel metallurgy, petrochemicals, medical and other industries, storage containers, statues (reducing corrosion of acid rain on them) and sensors (in acid/alkaline environment).

Resistant to organic solvents, cosmetics and sweat: such as (1) paraffins, olefins, alcohols, aldehydes, amines, esters, ethers, ketones, aromatic hydrocarbons, hydrogenated hydrocarbons, terpen hydrocarbons, halogenated hydrocarbons, heterocyclic compounds, solvents containing nitrogen compounds and sulfur compounds; (2) cosmetics packaging container; and (3) fingerprint locks and earphones.

Resistance to cold and heat cycle impact (e.g., −40° C. to +75° C.) and resistance to humidity and heat alternating (e.g., humidity: 75%-95%): electrical, electronic and automotive electrical appliances, such as equipment in the fields of aviation, automotive, home appliances, scientific research and so on.

The present invention is described in detail below with reference to specific embodiments, but the present invention is not limited to the specific embodiments.

Embodiment B1

This embodiment includes a method for preparing an organosilicon, hard nano-protective coating. The method comprises at least (1) a pre-treatment step; (2) a treatment/generation step for organosilicon coating; (3) a surface hardening step; and (4) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 10 mTorr, an inert gas Ar is introduced, and a movement mechanism is turned on so that the substrate moves in the reaction chamber.

In step (1), the substrate can be a solid material, and the solid material can be a block polytetrafluoroethylene sheet.

In step (1), the reaction chamber can be a rotating chamber with a volume 50 L, the temperature of the reaction chamber can be controlled at 30° C., and the flow rate of the inert gas can be 5 SCCM.

In step (1), the substrate can be moved in the reaction chamber. More particularly, the substrate can be moved in a circular manner relative to the reaction chamber at a speed of 3 rpm.

(2) Preparation of organosilicon coating: A monomer vapor is introduced into the reaction chamber to achieve a vacuum degree of 30 mTorr, the plasma discharge is turned on for chemical vapor deposition, and an organosilicon nano-coating is prepared via chemical vapor deposition on a surface of the substrate.

In some embodiments, the monomer vapor composition can be a mixture of an organosilicon monomer containing a double bond structure and three polyfunctional unsaturated hydrocarbons or hydrocarbon derivatives. The mass fraction of the polyfunctional unsaturated hydrocarbons or hydrocarbon derivatives in the monomer vapor is 15%.

In step (2), plasma can be discharged for chemical vapor deposition, and the plasma discharge process during the deposition process can be a low-power continuous discharge, and specifically includes the following deposition processes at least once.

The deposition process includes a pre-treatment stage and a coating stage. The plasma discharge power in the pre-treatment stage can be 150 W, and the continuous discharge time can be 450 s. Then, in the coating stage, the plasma discharge power can be adjusted to 150 W and the continuous discharge time can be 600 s.

In step (2), the monomer vapor can be atomized and volatilized through a feeding pump and can then be introduced into the reaction chamber at a low pressure of 10 mTorr. The flow rate of the introduced monomer vapor can be 1000 μL/min.

The organosilicon monomer containing a double bond structure can include 3-butenyltrimethylsilane. The three polyfunctional unsaturated hydrocarbons and hydrocarbon derivatives can include 1,4-pentadiene, ethoxylated trimethylolpropane triacrylate and ethylene glycol diacrylate.

(3) Surface hardening: In this step, the process stops introducing the monomer vapor. Oxygen can be introduced at a flow rate of 10 μL/min, and the plasma discharge power can be 50 W. The continuous discharge time can be 180 s, and the surface of the organosilicon nano-coating can be hardened.

In some embodiments, the plasma discharge in the step (2) and step (3) can be a radio frequency discharge.

(4) Post-treatment: In this step, the process stops introducing oxygen and discharging the plasma at the same time. Vacuumizing is continued and the vacuum degree of the reaction chamber is kept as 10 mTorr for 1 min. Then air is introduced to the reaction chamber until the pressure thereof reaches an atmospheric pressure. The movement of the substrate is stopped and then the substrate is taken out.

By the foregoing steps, a PTFE board deposited with an organosilicon coating can be formed. The PTFE board has been tested for mold resistance according to the GJB150.10A-2009 and the test result is shown in the following table.

PTFE board-performance test

| Thickness | Water contact angle | Hardness | Adhesion | Mold resistance grade | Degree of surface mold spots |
|---|---|---|---|---|---|
| 356 nm | 105° | 2H | Low adhesion and water droplets are easy to slide. | Grade 2 | 4% |
| 347 nm | 105° | 2H | | Grade 2 | 4% |
| 351 nm | 103° | 2H | | Grade 2 | 4% |

Embodiment B2

This embodiment includes a method for preparing an organosilicon, hard nano-protective coating. The method comprises at least (1) a pre-treatment step; (2) a treatment/generation step for organosilicon coating; (3) a surface hardening step; and (4) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 60 mTorr, an inert gas He is introduced, and a movement mechanism is turned on so that the substrate moves.

In step (1), the substrate can be a solid material, and the solid material can be a block of aluminum alloy material.

In step (1), the reaction chamber can be a cubic chamber with a volume 250 L, the temperature of the reaction chamber can be controlled at 43° C., and the flow rate of the inert gas can be 18 SCCM.

In step (1), the substrate can be moved to perform a planetary movement at a revolution speed of 2 rpm and a rotation speed of 6 rpm.

(2) Preparation of organosilicon coating: A monomer vapor is introduced into the reaction chamber to achieve a vacuum degree of 110 mTorr, the plasma discharge is turned on for chemical vapor deposition, and an organosilicon nano-coating is prepared via chemical vapor deposition on a surface of the substrate.

The monomer vapor composition can be: a mixture of three organosilicon monomers containing a Si—O—C structure and four polyfunctional unsaturated hydrocarbons or hydrocarbon derivatives. The mass fraction of the polyfunctional unsaturated hydrocarbons or hydrocarbon derivatives in the monomer vapor is 23%.

In step (2), plasma can be discharged for chemical vapor deposition. The plasma discharge process during the deposition process can be a low-power continuous discharge, and specifically includes the following deposition processes for at least three times.

The deposition process includes a pre-treatment stage and a coating stage. The plasma discharge power in the pre-treatment stage can be 600 W, and the continuous discharge time can be 60 s. Then, in the coating stage, the plasma discharge power can be adjusted to 10 W and the continuous discharge time can be 3600 s.

In step (2), the monomer vapor is atomized and volatilized through a feeding pump and is then introduced into the reaction chamber at a low pressure of 60 mTorr, and the flow rate of the introduced monomer vapor is 700 μL/min.

In some embodiments, the three organosilicon monomers containing a Si—Cl structure can be methylvinyldichlorosilane, trichloro(3,3,3-trifluoropropyl) silane, and tributylchlorosilane.

In some embodiments, the four polyfunctional unsaturated hydrocarbons and hydrocarbon derivatives can include 1,4-pentadiene, polyethylene glycol diacrylate, ethylene glycol diacrylate, and diethylene glycol divinyl ether.

(3) Surface hardening: The introduction of the monomer vapor is stopped. Oxygen and water vapor are introduced at a flow rate of 30 μL/min. The oxygen occupies 26% (of the reaction chamber) by volume. The plasma discharge power can be 70 W, the continuous discharge time can be 140 s, and the surface of the organosilicon nano-coating can be hardened. The plasma discharge discussed in step (2) and step (3) can be an intermediate-frequency discharge.

(4) Post-treatment: Introduction of oxygen and water vapor is stopped, the plasma discharge is stopped at the same time. Vacuumizing is continued, and the vacuum degree of the reaction chamber is kept as 100 mTorr for 2 minutes. Then air is introduced into the reaction chamber until the pressure thereof reaches an atmospheric pressure. The substrate can then be taken out.

The hardness of the above aluminum alloy material coating is 4H. Its acid and alkali resistance have been tested by being exposed to acid and alkali environments. The test results are as follows:

| Material | Acid and alkaline reagent | Time 48 h | 96 h | 144 h | 192 h |
|---|---|---|---|---|---|
| Aluminum alloy | Acid salt spray | pass | pass | pass | pass |
| | Neutral salt spray | pass | pass | pass | pass |
| | Alkaline salt spray | pass | pass | pass | pass |
| | 5% acetic acid solution | pass | pass | pass | pass |
| | 5% NaOH solution | pass | pass | pass | pass |

Embodiment B3

This embodiment includes a method for preparing an organosilicon, hard nano-protective coating. The method comprises at least (1) a pre-treatment step; (2) a treatment/generation step for organosilicon coating; (3) a surface hardening step; and (4) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 130 mTorr, a mixture of inert gas Ar and He is introduced, and a movement mechanism is turned on so that the substrate moves.

In step (1), the substrate can be a solid material, and the solid material can be a block of alloy steel plate material.

In step (1), the reaction chamber can be a rotating chamber with a volume 480 L, the temperature of the reaction chamber can be controlled at 50° C., and the flow rate of the inert gas can be 80 SCCM.

In step (1), the substrate can perform a circular movement at a speed of 8 rpm.

(2) Preparation of organosilicon coating: A monomer vapor is introduced into the reaction chamber to achieve a vacuum degree of 170 mTorr. Plasma discharge is turned on for chemical vapor deposition. An organosilicon nano-coating is prepared/generated via chemical vapor deposition on a surface of the substrate.

The monomer vapor composition can be a mixture of four organosilicon monomers containing a Si—O—C structure and one polyfunctional unsaturated hydrocarbon or hydrocarbon derivative, and the mass fraction of the polyfunctional unsaturated hydrocarbons or hydrocarbon derivatives in the monomer vapor is 37%.

A plasma discharge process can be performed for chemical vapor deposition. The plasma discharge process during the deposition process can be a pulse discharge, and specifically includes the following deposition processes for four times.

The deposition process can include a pre-treatment stage and a coating stage. The plasma discharge power in the pre-treatment stage can be 150 W, and the continuous discharge time is 450 s. Then, in the coating stage, a pulse discharge can be performed, with the power of 300 W and time of 600 s. The pulse discharge frequency can be 1 HZ, and the duty cycle of the pulse can be 1:1.

In step (2), the monomer vapor is atomized and volatilized through a feeding pump and is then introduced into the reaction chamber at a low pressure of 130 mTorr, and the flow rate of the introduced monomer vapor is 580 μL/min.

The four organosilicon monomers containing a Si—O—C structure can be diphenyldiethoxysilane, dodecyltrimethoxysilane, triethylvinylsilane, and hexaethylcyclotrisiloxane. The polyfunctional unsaturated hydrocarbon derivative can include neopentyl glycol diacrylate.

(3) Surface hardening: The introduction of the monomer vapor is stopped, oxygen and water vapor are introduced at a flow rate of 60 μL/min, and the oxygen occupies 37% (of the reaction chamber) by volume. The plasma discharge power can be 60 W, the continuous discharge time can be 130 s, and the surface of the organosilicon nano-coating is hardened.

The plasma discharge mode in step (2) and step (3) can be high-frequency discharge, and the waveform of the high-frequency discharge can be a bipolar pulse.

(4) Post-treatment: Introduction of the oxygen and water vapor is stopped, and the plasma discharge is stopped at the same time. Vacuumizing is continued. The vacuum degree of the reaction chamber is kept as 160 mTorr for 3 minutes. Then air is introduced to the reaction chamber until the pressure thereof reaches an atmospheric pressure. The substrate is taken out.

The above alloy steel plate material can be coated with a coating hardness of 4H. The alloy steel plate material can then be immersed in an organic solvent to test the resistance to organic solvents. The test results are as follows:

| Substrate | Chemical reagent | Time 48 h | 96 h | 144 h | 192 h |
|---|---|---|---|---|---|
| Block alloy steel plate material | Acetone | pass | pass | pass | pass |
| | Cyclohexane | pass | pass | pass | pass |
| | Petroleum ether | pass | pass | pass | pass |
| | Xylene | pass | pass | pass | pass |
| | n-propanol | pass | pass | pass | pass |

Embodiment B4

This embodiment includes a method for preparing an organosilicon, hard nano-protective coating. The method comprises at least (1) a pre-treatment step; (2) a treatment/generation step for organosilicon coating; (3) a surface hardening step; and (4) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 160 mTorr, an inert gas He is introduced, and a movement mechanism is turned on so that the substrate moves.

In step (1), the substrate can be a solid material, and the solid material can be a block of aluminum material and a PCB board.

In step (1), the volume of the reaction chamber is 640 L, the temperature of the reaction chamber is controlled at 53° C., and the flow rate of the inert gas is 160 SCCM.

In step (1), the substrate can be moved to linearly reciprocate at a movement speed of 32 mm/min.

(2) Preparation of organosilicon coating: A monomer vapor is introduced into the reaction chamber to achieve a vacuum degree of 210 mTorr, the plasma discharge is turned on for chemical vapor deposition, and an organosilicon nano-coating is prepared via chemical vapor deposition on a surface of the substrate.

The monomer vapor composition can be a mixture of three organosilicon monomers containing Si—N—Si or Si—O—Si structure and five polyfunctional unsaturated hydrocarbons or hydrocarbon derivatives, and the mass fraction of the polyfunctional unsaturated hydrocarbons or hydrocarbon derivatives in the monomer vapor is 65%.

A plasma discharge process is performed for chemical vapor deposition. The plasma discharge process during the deposition process can be a pulse discharge, and specifically includes the following deposition processes for at least once.

The deposition process includes a pre-treatment stage and a coating stage. The plasma discharge power in the pre-treatment stage is 600 W, and the continuous discharge time is 60 s. Then, in the coating stage, a pulse discharge is performed, with the power of 10 W and time of 3600 s. The pulse discharge frequency can be 1000 HZ, and the duty cycle of the pulse can be 1:500.

In step (2), the monomer vapor can be atomized and volatilized through a feeding pump and can be then introduced into the reaction chamber at a low pressure of 160 mTorr, and the flow rate of the introduced monomer vapor can be 260 μL/min.

The three organosilicon monomers containing a Si—N—Si or Si—O—Si structure can be: hexamethylcyclotrisilaneamino, hexamethyldisilazane, and hexamethyl disiloxane.

The five polyfunctional unsaturated hydrocarbons and hydrocarbon derivatives can be: 1,3-butadiene, 1,6-hexanediol diacrylate, ethylene glycol diacrylate, diethylene glycol divinyl ether, and neopentyl glycol diacrylate.

(3) Surface hardening: The introduction of the monomer vapor is stopped, water vapor is introduced at a flow rate of 100 μL/min, the plasma discharge power is 100 W, the continuous discharge time is 50 s, and the surface of the organosilicon nano-coating is hardened. The plasma discharge in step (2) and step (3) can be a microwave discharge.

(4) Post-treatment: Introduction of water vapor is stopped, and the plasma discharge is stopped at the same time. Vacuumizing is continued, and the vacuum degree of the reaction chamber is kept as 200 mTorr for 4 minutes. Then air is introduced in the reaction chamber until the pressure thereof reaches to an atmospheric pressure. Then the substrate is taken out.

The hardness of the organosilicon coating deposited on the block of aluminum material can be 4H, and the hardness of the organosilicon coating deposited on the PCB can be 2H. The two coated materials are exposed to a cold and hot cycle test environment to test the cold and hot cycle impact resistance. The test results are as follows:

| Test substrate | Experimental conditions | Times of cycle | Experiment time | Result detection |
|---|---|---|---|---|
| Aluminum substrate | −40° C.~+75° C. | 25 | 2 h | No impact on appearance Good performance |
| PCB board | −40° C.~+75° C. | 25 | 2 h | No impact on appearance Good performance |

Embodiment B5

This embodiment includes a method for preparing an organosilicon, hard nano-protective coating. The method comprises at least (1) a pre-treatment step; (2) a treatment/generation step for organosilicon coating; (3) a surface hardening step; and (4) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 200 mTorr, an inert gas Ar is introduced, and a movement mechanism is turned on so that the substrate moves.

In step (1), the substrate is a solid material, and the solid material is an electronic component.

In step (1), the volume of the reaction chamber is 1000 L, the temperature of the reaction chamber is controlled at 60° C., and the flow rate of the inert gas is 300 SCCM.

In step (1), the substrate is moved to reciprocate in a curve manner at a speed of 120 mm/min.

(2) Preparation of organosilicon coating: A monomer vapor is introduced into the reaction chamber to achieve a vacuum degree of 300 mTorr, the plasma discharge is turned on for chemical vapor deposition, and an organosilicon nano-coating is prepared via chemical vapor deposition on a surface of the substrate.

The monomer vapor composition is: a mixture of four organosilicon monomers containing an annular structure and three polyfunctional unsaturated hydrocarbons or hydrocarbon derivatives, and the mass fraction of the polyfunctional unsaturated hydrocarbons or hydrocarbon derivatives in the monomer vapor is 48%.

A plasma discharge process has been performed for chemical vapor deposition. The plasma discharge process during the deposition process is a periodic alternating discharge, and specifically includes the following deposition processes for three times.

The deposition process includes a pre-treatment stage and a coating stage. The plasma discharge power in the pre-treatment stage is 150 W, and the continuous discharge time is 450 s. Then, in the coating stage, the plasma is periodically alternating discharge output, with the power of 300 W, time of 600 s and AC frequency of 1 Hz. The waveform of the plasma periodically alternating discharge output is a sawtooth waveform.

In step (2), the monomer vapor is atomized and volatilized through a feeding pump and is then introduced into the reaction chamber at a low pressure of 200 mTorr, and the flow rate of the introduced monomer vapor is 10 μL/min.

The four organosilicon monomers containing an annular structure are bis(triphenylsilyl) ester, trifluoropropylmethylcyclotrisiloxane, 2,2,4,4-tetramethyl-6,6,8,8-tetraphenylcyclotetrasiloxane, and tetramethyltetravinylcyclotetrasiloxane.

The three polyfunctional unsaturated hydrocarbon derivatives are 1,4-pentadiene, tripropylene glycol diacrylate, and neopentyl glycol diacrylate.

(3) Surface hardening: The introduction of the monomer vapor is stopped, oxygen and water vapor are introduced at a flow rate of 80 μL/min, and the oxygen occupies 23% by volume, the plasma discharge power is 80 W, the continuous discharge time is 90 s, and the surface of the organosilicon nano-coating is hardened.

The plasma discharge mode in step (2) and step (3) can be an electric spark discharge.

(4) Post-treatment: The introduction of oxygen and water vapor is stopped and the plasma discharge is stopped at the same time, the reaction chamber is filled with an inert gas to a pressure of 2000 mTorr, and then it is vacuumized to 10 mTorr, the above steps of inflating and vacuumizing are performed once. Air is introduced to the reaction chamber until the pressure thereof reaches an atmospheric pressure.

The movement of the substrate is stopped, and then the substrate is taken out. The above-mentioned coated electronic components are exposed to the humid and heat test environment to test their humid heat resistance property. The hardness of the coating is 2H. The test results are as follows:

| Test substrate | Test conditions and results | | | | | | |
|---|---|---|---|---|---|---|---|
| Electronic Components | Temperature | | 25° C. | | | | |
| | Humidity | | 75 | 80 | 85 | 90 | 95 |
| | Time | 12 h | Pass | Pass | Pass | Pass | Pass |
| | Time | 24 h | Pass | Pass | Pass | Pass | Pass |
| | Time | 36 h | Pass | Pass | Pass | Pass | Pass |
| | Time | 48 h | Pass | Pass | Pass | Pass | Pass |

Embodiment B6

This embodiment includes a method for preparing an organosilicon, hard nano-protective coating. The method comprises at least (1) a pre-treatment step; (2) a treatment/generation step for organosilicon coating; (3) a surface hardening step; and (4) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 180 mTorr, an inert gas Ar is introduced, and a movement mechanism is turned on so that the substrate moves.

In step (1), the substrate is a solid material, and the solid material is an electrical component.

In step (1), the volume of the reaction chamber is 780 L, the temperature of the reaction chamber is controlled at 50° C., and the flow rate of the inert gas is 200 SCCM.

In step (1), the substrate performs a planetary movement at a revolution speed of 4 rpm and a rotation speed of 3 rpm.

(2) Preparation of organosilicon coating: A monomer vapor is introduced into the reaction chamber to achieve a vacuum degree of 280 mTorr, the plasma discharge is turned on for chemical vapor deposition, and an organosilicon nano-coating is prepared via chemical vapor deposition on a surface of the substrate.

The monomer vapor composition is a mixture of five organosilicon monomers containing an annular structure and five polyfunctional unsaturated hydrocarbons or hydrocarbon derivatives, the mass fraction of the polyfunctional unsaturated hydrocarbons or hydrocarbon derivatives in the monomer vapor is 45%.

A plasma discharge process has been performed for chemical vapor deposition. The plasma discharge process during the deposition process is a periodic alternating discharge, and specifically includes the following deposition processes for once.

The deposition process includes a pre-treatment stage and a coating stage. The plasma discharge power in the pre-treatment stage is 600 W, and the continuous discharge time is 60 s. Then, in the coating stage, the plasma is periodically alternating discharge output, with the power of 10 W, time of 3600 s and AC frequency of 1000 Hz. The waveform of the plasma periodically alternating discharge output is a full-wave rectified waveform.

In step (2), the monomer vapor is atomized and volatilized through a feeding pump and is then introduced into the reaction chamber at a low pressure of 180 mTorr, and the flow rate of the introduced monomer vapor is 49 μL/min.

The five organosilicon monomers containing an annular structure are hexamethylcyclotrisiloxane, octamethylcyclotetrasiloxane, decamethylcyclopentasiloxane, octaphenylcyclotetra siloxane, and diphenyldihydroxysilane. The five polyfunctional unsaturated hydrocarbons and hydrocarbon derivatives are: 1,3-butadiene, isoprene, ethoxylated trimethylolpropane triacrylate, polyethylene glycol diacrylate and 1,6-hexanediol diacrylate.

(3) Surface hardening: The introduction of the monomer vapor is stopped, oxygen and water vapor are introduced at a flow rate of 100 μL/min, and the oxygen occupies 58% (of the reaction chamber) by volume. The plasma discharge power is 70 W, the continuous discharge time is 120 s, and the surface of the organosilicon nano-coating is hardened.

The plasma discharge in step (2) and step (3) can be an intermediate-frequency discharge, and the waveform of the intermediate-frequency discharge can be sinusoidal.

(4) Post-treatment: The introduction of oxygen and water vapor is stopped and the plasma discharge is stopped at the same time, the reaction chamber is filled with air to a pressure of 5000 mTorr, and then it is vacuumized to 200 mTorr. The foregoing steps of inflating and vacuumizing are performed for ten times. Air is introduced to the reaction chamber until the pressure thereof reaches an atmospheric pressure, the movement of the substrate is stopped, and then the substrate is taken out. The above-mentioned coated electrical component has a coating hardness of 4H. The resistance to underwater electrification and underwater immersion have been tested in the environments described in the international industrial waterproof rating standard IPX7. The test results are as follows. The following table is the test result of the time for the coating prepared in the present embodiment to enable a current to reach 1 mA at different voltages. In IPX 7 test (1-meter underwater immersion test for 30 minutes), electrical components work normally.

| Voltage | 3.8 V | 5 V | 12.5 V |
|---|---|---|---|
| Time | >48 h | >24 h | >24 h |

High-Insulation Nano-Protective Coating—Embodiments C1-C6

The present invention also provides a method for preparing for a high-insulation nano-protective coating. In the preparation process, low dipole moment and highly chemically inert organic monomers are filtered out, and the free volume and compactness of the coating are regulated via a polyfunctional monomer, so that the coating has high insulation performance, and excellent protection performance. Because the present (plasma chemical vapor deposition) method is not only applicable to a variety of monomers but also has a strong controllability of the composition and structure of the formed coating, the composition and structure of the coating can be regulated and constructed by optimizing the design of the monomer and optimization of process parameters so as to enable the deposited coating to have better protection performance and insulation performance than existing coatings (such as parylene) with the same thickness.

The technical solution adopted by the present invention is as follows: a method for preparing a high-insulation nano-protective coating, comprising:

(C1) Pre-treatment:

A substrate is placed in a reaction chamber of a nano-coating preparation equipment, the reaction chamber is continuously vacuumized, the vacuum degree within the reaction chamber is adjusted to 10 to 200 mTorr, an inert gas He, Ar or a mixture of He and Ar is introduced, and a movement mechanism is turned on so that the substrate moves in the reaction chamber.

(C2) Preparation of a High-Insulation Coating:

A monomer vapor is introduced into the reaction chamber to achieve a vacuum degree of 30-300 mTorr. Plasma discharge is turned on for chemical vapor deposition, and a high-insulation nano-coating is prepared via chemical vapor deposition on a surface of the substrate.

In some embodiments, the monomer vapor composition is: a mixture of at least one low dipole moment organic monomer and at least one polyfunctional unsaturated hydrocarbon or hydrocarbon derivative, and the mass fraction of the polyfunctional unsaturated hydrocarbon or hydrocarbon derivative in the monomer vapor is 15-65%.

The monomer vapor can be atomized and volatilized through a feeding pump and can then be introduced into the reaction chamber at a low pressure of 10-200 mTorr, and the flow rate of the introduced monomer vapor can be 10-1000 μL/min.

(C3) Post-Treatment:

Introduction of the monomer vapor is stopped, and the plasma discharge is stopped at the same time. Vacuumizing is continued, and the vacuum degree of the reaction chamber is kept as 10-200 mTorr for 1-5 minutes. Then air is introduced to the reaction chamber until the pressure thereof reaches an atmospheric pressure. The movement of the substrate is stopped and then the substrate is taken out.

In some embodiments, alternatively, the introduction of monomer vapor is stopped and the plasma discharge is stopped at the same time. The reaction chamber is filled with air or an inert gas to a pressure of 2000-5000 mTorr, and then it is vacuumized to 10-200 mTorr. The above steps of inflating and vacuumizing are performed at least once, air is introduced to the reaction chamber until the pressure thereof reaches an atmospheric pressure. The movement of the substrate is stopped, and then the substrate is taken out.

In a low-vacuum plasma discharge environment, free radicals can be formed through effective output of energy to enable chemical bond breaks in monomers with a more active molecular structure, and the free radicals and surface active groups of electronic products initiate polymerization by means of chemical bond bonding to form a nano film. Finally, a high-insulation nano-coating is formed on the surface of the substrate.

In step (C1), the substrate moves in the reaction chamber. The substrate is moved to reciprocate in a linear or a curve manner relative to the reaction chamber. The curved movement includes a circular movement, an elliptical movement, a planetary movement, a spherical or other movement in irregularly curved paths, etc.

In step (C1), the substrate is a solid material. The solid material can be an electronic product, an electrical component, a semi-finished electronic assembly, a PCB board, a metal plate, a polytetrafluoroethylene sheet or an electronic component, and any interface of the surface of the substrate can be exposed to and used in water environment, mold environment, acid and alkaline solvent environment, acid and alkaline salt mist environment, acidic atmospheric environment, organic solvent immersion environment, cosmetics environment, sweat environment, cold and hot cycle impact environment or wet heat alternating environment after the preparation of the organosilicon nano-coating.

In step (C1), the reaction chamber is a rotating chamber or a cubic chamber with a volume of 50-1000 L, the temperature of the reaction chamber is controlled at 30-60° C., and the flow rate of the inert gas is 5-300 SCCM.

In step (C2): plasma discharge is performed for chemical vapor deposition, and the plasma discharge process during the deposition process includes low-power continuous discharge, pulse discharge or periodic alternating discharge.

The plasma discharge process during the deposition process can be a low-power continuous discharge, and specifically includes the following deposition processes for at least once.

The deposition process includes a pre-treatment stage and a coating stage. The plasma discharge power in the pre-treatment stage is 150-600 W, and the continuous discharge time is 60-450 s. Then, in the coating stage, the plasma discharge power is adjusted to 10-150 W and the continuous discharge time is 600-3600 s.

The plasma discharge process during the deposition process can be a pulse discharge, and specifically includes the following deposition processes for at least once.

The deposition process includes a pre-treatment stage and a coating stage. The plasma discharge power in the pre-treatment stage is 150-600 W, and the continuous discharge time is 60-450 s. Then, in the coating stage, a pulse discharge, with the power of 10-300 W and time of 600 s to 3600 s, can be applied. The pulse discharge frequency can be 1-1000 HZ, and the duty cycle of the pulse is 1:1-1:500.

The plasma discharge process during the deposition process can be a periodic alternating discharge, and specifically includes the following deposition processes for at least once.

The deposition process includes a pre-treatment stage and a coating stage. The plasma discharge power in the pre-treatment stage is 150-600 W, and the continuous discharge time is 60-450 s. Then, it is the coating stage. During the coating phase, the plasma is periodically alternating discharge output, with the power of 10-300 W, time of 600 s to 3600 s and AC frequency of 1-1000 Hz. The waveform of the plasma periodically alternating discharge output is a sawtooth waveform, sine waveform, square wave waveform, full-wave rectified waveform, or half-wave rectified waveform.

The low dipole moment organic monomer includes: p-xylene, benzene, toluene, carbon tetrafluoride, a-methylstyrene, poly-p-xylylene, dimethylsiloxane, polydimethylsiloxane with a molecular weight of 500-50,000, allylbenzene, decafluorobiphenyl, decafluorobenzophenone, perfluoroallylbenzene, tetrafluoroethylene, hexafluoropropylene, 1H,1H-perfluorooctylamine, iodoperfluorododecane, perfluorotributylamine, 1,8-diiodoperfluorooctane, tridecafluorohexyl iodide, nonafluorobutyl iodide, perfluorodecyl iodide, perfluorooctyl iodide, 1,4-bis(2',3'-epoxypropyl)perfluorobutane, perfluoro-2-methyl-2-pentene, 2-(perfluorobutyl) ethyl methacrylate, 2-(perfluorooctyl) ethyl methacrylate, 2-(perfluorooctyl) iodoethane, perfluorodecyl ethyl iodide, 1,1,2,2-tetrahydroperfluorohexyl iodide, perfluorobutyl ethylene, 1H,1H,2H-Perfluoro-1-decene, 2,4,6-tris(pentadecafluoroheptyl)-1,3,5-triazine, (perfluorohexyl)ethylene, 3-(Perfluoro-n-octyl)propenoxide, perfluoro-compound, (perfluorododecyl)ethylene, 1-Iodo-1H,1H,2H,2H-perfluorotetradecane, dibromo-p-xylene, and 1,1,4,4-tetraphenyl-1,3-butadiene.

The polyfunctional unsaturated hydrocarbons and hydrocarbon derivatives include: 1,3-butadiene, isoprene, 1,4-pentadiene, ethoxylated trimethylolpropane triacrylate, tripropylene glycol diacrylate, polyethylene glycol diacrylate, 1,6-hexanediol diacrylate, ethylene glycol diacrylate, diethylene glycol divinyl ether or neopentyl glycol diacrylate.

In step (C2), the plasma discharge mode is radio frequency discharge, microwave discharge, intermediate frequency discharge, high frequency discharge, electric spark discharge, and the waveforms of the high frequency discharge and intermediate frequency discharge are sinusoidal or bipolar pulses. RF plasma is a plasma generated by discharge of a high-frequency electromagnetic field. In microwave methods, microwave energy is used to excite the plasma, which has the advantage of high energy utilization efficiency. At the same time, because of electrodeless discharge, the plasma is pure. It is an excellent method for high-quality, high-speed and large-area preparation.

During the coating preparation process, the movement characteristics of the substrate and the plasma discharge energy are linked. At the time of the plasma discharge during the preparation process, the substrate moves, which improves the coating deposition efficiency and improves the uniformity and compactness of the coating thickness.

The prepared coating can be insulative, waterproof and moisture proof, mildew resistant, acid and alkaline solvent resistant, acid and alkaline salt spray resistant, acidic atmosphere resistant, organic solvent immersion resistant, cosmetics resistant, sweat resistant, resistant to cold and heat cycle impact (e.g., −40° C. to +75° C.), resistant to humidity and heat change (e.g., 75%-95% of humidity) and has other characteristics. In addition to the above-mentioned protective properties, in case of a thickness of 1-1000 nm, the effect of the coating on the RF communication signals with frequency of 10M-8G is less than 5%.

Compared with the prior art, the above technical solution of the present invention has the following advantages:

1. Plasma chemical vapor deposition technology method is more environmentally friendly than the liquid phase conformal coating method. Compared with the parylene evaporative deposition method, the deposition temperature is lower, the speed is faster, the coating structure and composition are strongly controllable, and the monomer selectivity is strong.

2. The substrate moves in the reaction chamber, making the thickness of the substrate coating in different positions tend to be the same, which solves the problem of uneven thickness of the surface coating of the substrate due to the different monomer density in different regions of the reaction chamber. During the preparation process, the movement characteristics of the substrate and the plasma discharge energy are linked. While the discharge energy is output, the substrate moves, which improves the deposition efficiency and significantly improves the compactness of the resulted protective coating. At the same time, due to the increased deposition efficiency, the amount of chemical monomer raw materials used for monomer vapor is only 10%-15% of that used in other existing technologies, thereby reducing emission of exhaust gas. It is more environmentally friendly and is of great significance in improving actual production efficiency.

3. In the present invention, low dipole moment and highly chemically inert organic monomers are filtered out, and the free volume and compactness of the coating are regulated via a polyfunctional monomer, so that the coating has high insulation performance and excellent protection performance.

(1) In the present invention, a benzene ring of high symmetry and a benzene derivative or a perfluorinated compound thereof are selected as monomers. After polymerization, the molecule has low polarity due to symmetry or the fact that each carbon atom is covered by a large number of fluorine atoms. The dielectric constant is very low, less than 2.8, and the insulation is high.

(2) Because the benzene ring structure and fluorocarbon structure have high chemical inertness, the polymers formed by them have excellent chemical stability.

(3) The length and functionality of the molecular chain of the cross-linking agent can effectively improve the compactness and free volume of the coating, thereby improving insulation and protection performance.

4. By introducing other monomers with cross-linked structure, controlling of the proportion of monomers and giving the equipment corresponding energy output and effective changes in process parameters according to the molecular bond energy, bond length difference and vaporization temperature difference of different monomers, a composite polymer nano-coating with graded structure is obtained. Such as a polyxylene-fluorocarbon multilayer composite structure, which not only ensures the insulation of the film but also improves the resistance to environmental corrosion of electronic products and other products.

Electronic equipment in daily life is easily damaged by the corrosion of the corrosive environment and is basically in the corrosive environment during the use process. After a long time, it will cause irreparable damage to electronic equipment such as short circuits and open circuits, etc. The coating method of the present invention greatly improves the great significance of nanometer in improving the actual production efficiency. It improves the service life of the coating in corrosive environment and the protection effect of the product. It is mainly used in the following products:

(1) Portable device keyboard: The portable keyboard is small and light, and is often used in computers, mobile phones and other devices. It is convenient for users to work during trip. However, when it encounters contamination of common liquids, such as the accidental overturning of the tea cup, the infiltration of rain and sweat, the keyboard is easily short-circuited and then damaged. After the keyboard is coated with this type of nano-coating, it can ensure that the keyboard surface is easy to clean, and the function is intact after contact with water, so that the keyboard can adapt to more severe environment.

(2) LED display: LED display is used for product promotion, store decoration, lighting, warning and other purposes. Some of its applications are in harsh environment of rain or dust. In rainy days, the outdoor LED advertising screens in shopping malls, road warning lights and LED display control panels in production workshops, etc. are easy to fail, and dust is easy to be accumulated and it is difficult to clean. After application of this nano-coating, the above problems can be effectively solved.

(3) Intelligent fingerprint lock: Fingerprint lock is a smart lock, which integrates computer information technology, electronic technology, mechanical technology, and modern hardware technology, and is widely used in the public security criminal investigation and judicial fields. However, its internal circuit is easily short-circuited in case of water, it is difficult to repair and requires violent unlocking. This problem can be avoided after using this coating.

(4) Hearing aids and Bluetooth headsets: There are no communication cables for hearing aids or Bluetooth headsets. After this coating is applied, users can use such products in a water environment for a certain period of time, such as bathing, rainy days, and the devices will not be damaged due to rain water.

(5) Sensors: Some sensors need to work in a liquid environment, such as water pressure and oil pressure sensors, sensors used in underwater operating equipment and sensors that often encounter water in the working environment. These sensors will not fail due to the invading of liquid into the internal structure of the mechanical equipment after this coating is applied.

(6) 3C products: such as mobile phones, notebooks, PSP, etc.

(7) Other equipment that needs to be waterproof: It includes equipment that needs to work in a humid environment, or that may encounter accidents such as common liquid spill, which will affect the normal operation of the internal weak current lines.

The organosilicon nano-coating prepared by this method can also be applied to the following different environments and related products involving:

Waterproof, moisture-proof and mold-proof: such as (1) house interior parts: bathroom ceiling, wallpaper, chandeliers, curtains and window screens; (2) daily necessities: mosquito nets, lampshades, chopstick baskets and car rear-view mirrors; (3) cultural relics and artworks: copybooks, antiques, wood carvings, leather, bronzes, silk, costumes and ancient books; (4) electronic components and electronic products: sensors (operating in wet or dusty environment), chips of various electronic products (electronic blood pressure monitors and smart watches), circuit boards, mobile phones, LED screens and hearing aids; (5) precision instruments and optical equipment: mechanical watches and microscopes.

Resistance to acid and alkaline solvents, acid and alkaline salt spray and acidic atmosphere: such as (1) housing interior parts: wallpaper and tiles; (2) protective equipment: acid-resistant (alkali) gloves and acid-resistant (alkali) protective clothing; (3) mechanical equipment and pipelines: flue gas desulfurization equipment, seals (acid/alkaline lubricating oil), pipelines, valves, large-diameter marine transmission pipeline linings, etc.; (4) various reaction kettles and reactors; (5) chemical production and storage; sewage treatment and aeration tanks; (6) others: acid-alkali workshops, alkali-proof aerospace, energy and power, steel metallurgy, petrochemicals, medical and other industries, storage containers, statues (reducing corrosion of acid rain on them) and sensors (in acid/alkaline environment).

Resistant to organic solvents, cosmetics and sweat: such as (1) paraffins, olefins, alcohols, aldehydes, amines, esters, ethers, ketones, aromatic hydrocarbons, hydrogenated hydrocarbons, terpen hydrocarbons, halogenated hydrocarbons, heterocyclic compounds, solvents containing nitrogen compounds and sulfur compounds; (2) cosmetics packaging container; and (3) fingerprint locks and earphones.

Resistance to cold and heat cycle impact (e.g., −40° C. to +75° C.) and resistance to humidity and heat alternating (e.g., humidity: 75%-95%): electrical, electronic and automotive electrical appliances, such as equipment in the fields of aviation, automotive, home appliances, scientific research and so on.

The present invention is described in detail below with reference to specific embodiments, but the present invention is not limited to the specific embodiments.

Embodiment C1

A preparation method for a high-insulation nano-protective coating, comprising the following steps: (1) a pre-treatment step; (2) a treatment/generation step for high-insulation coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 10 mTorr, an inert gas Ar is introduced, and a movement mechanism is turned on so that the substrate moves in the reaction chamber.

In step (1), the substrate can be a solid material, and the solid material can be a block aluminum material and a PCB board, and any interface of the substrate may be exposed to a humid heat test environment after a cold and heat cycle impact resistance coating is prepared.

In step (1), the reaction chamber can be a rotating chamber with a volume 50 L, the temperature of the reaction chamber can be controlled at 30° C., and the flow rate of the inert gas can be 5 SCCM.

In step (1), the substrate can be moved in the reaction chamber, and the substrate can be moved in a circular manner relative to the reaction chamber at a speed of 6 rpm.

(2) Preparation of a high-insulation coating: A monomer vapor is introduced into the reaction chamber to achieve a vacuum degree of 30 mTorr. Plasma discharge is turned on for chemical vapor deposition, and a high-insulation nano-coating is prepared via chemical vapor deposition on a surface of the substrate.

The monomer vapor composition can be: a mixture of one low dipole moment organic monomer and three polyfunctional unsaturated hydrocarbons and hydrocarbon derivatives, and the mass fraction of the polyfunctional unsaturated hydrocarbons or hydrocarbon derivatives in the monomer vapor is 15%.

The monomer vapor can be atomized and volatilized through a feeding pump and is then introduced into the reaction chamber at a low pressure of 10 mTorr, and the flow rate of the introduced monomer vapor is 10 μL/min.

The one low dipole moment organic monomer can be: tetrafluoroethylene;

The three polyfunctional unsaturated hydrocarbons and hydrocarbon derivatives are: 1,3-butadiene, ethoxylated trimethylolpropane triacrylate and polyethylene glycol diacrylate.

In step (2), plasma discharge for chemical vapor deposition. The plasma discharge process during the deposition process can be a low-power continuous discharge, and specifically includes the following deposition processes for once.

The deposition process includes a pre-treatment stage and a coating stage. The plasma discharge power in the pre-treatment stage is 150 W, and the continuous discharge time is 450 s. Then, during the coating stage, the plasma discharge power is adjusted to 10 W and the continuous discharge time is 3600 s.

The plasma discharge mode in step (2) can be radio frequency discharge;

(3) Post-treatment: Introduction of monomer vapor is stopped, and the plasma discharge is stopped at the same time. Vacuumizing is continued, and the vacuum degree of the reaction chamber is kept to 10 mTorr for 1 min. Air is introduced to the reaction chamber until the pressure thereof reaches an atmospheric pressure, and then the substrate is taken out.

The dielectric constant of the coating obtained by the above process is 2.73, and the aluminum material and PCB board after coating are subjected to a cold and heat cycle impact test. The test results are as follows:

| Test substrate | Experimental conditions | Times of cycle | Experiment time | Result detection |
|---|---|---|---|---|
| Aluminum material | −40° C. ~ +75° C. | 25 | 2 h | No impact on appearance Good performance |
| PCB board | −40° C. ~ +75° C. | 25 | 2 h | No impact on appearance Good performance |

The effects of a humid, heat alternating test of the above-mentioned coated aluminum materials are as follows:

| Experimental conditions | Temperature | | 55° C. | | | | |
|---|---|---|---|---|---|---|---|
| | Humidity | | 75% | 80% | 85% | 90% | 95% |
| Aluminum material | Time | 12 h | Pass | Pass | Pass | Pass | Pass |
| | Time | 24 h | Pass | Pass | Pass | Pass | Pass |
| | Time | 36 h | Pass | Pass | Pass | Pass | Pass |
| | Time | 48 h | Pass | Pass | Pass | Pass | Pass |

Embodiment C2

A preparation method for a high-insulation nano-protective coating, comprising the following steps: (1) a pre-treatment step; (2) a treatment/generation step for high-insulation coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 30 mTorr, an inert gas He is introduced, and a movement mechanism is turned on so that the substrate moves.

In step (1), the substrate is a solid material. The solid material can be a block aluminum material, and any interface of the substrate may be exposed to a humid heat alternating environment after a humid heat resistant coating is prepared.

In step (1), the reaction chamber can be a cubic chamber with a volume 250 L, the temperature of the reaction chamber can be controlled at 40° C., and the flow rate of the inert gas can be 15 SCCM.

In step (1), the substrate can be moved to perform a planetary movement at a revolution speed of 8 rpm and a rotation speed of 5 rpm.

(2) Preparation of a high-insulation coating: A monomer vapor is introduced into the reaction chamber to achieve a vacuum degree of 60 mTorr. Plasma discharge is turned on for chemical vapor deposition, and a high-insulation nano-coating is prepared via chemical vapor deposition on a surface of the substrate.

The monomer vapor composition can be: a mixture of four low dipole moment organic monomers and one polyfunctional unsaturated hydrocarbon or hydrocarbon derivative, and the mass fraction of the polyfunctional unsaturated hydrocarbons or hydrocarbon derivatives in the monomer vapor is 32%.

The monomer vapor can be atomized and volatilized through a feeding pump and is then introduced into the reaction chamber at a low pressure of 30 mTorr, and the flow rate of the introduced monomer vapor can be 90 μL/min.

The four low-dipole moment organic monomers can be: toluene, carbon tetrafluoride, 2-(perfluorobutyl) ethyl methacrylate and perfluorobutyl ethylene. The one polyfunctional unsaturated hydrocarbon or hydrocarbon derivative can be polyethylene glycol diacrylate.

In step (2), a plasma discharge process is performed for chemical vapor deposition. The plasma discharge process during the deposition process can be a low-power continuous discharge, and specifically includes the following deposition processes for six times.

The deposition process includes a pre-treatment stage and a coating stage. The plasma discharge power in the pre-treatment stage is 600 W, and the continuous discharge time is 60 s. Then, in the coating stage, the plasma discharge power is adjusted to 150 W and the continuous discharge time is 600 s.

The plasma discharge mode in step (2) can be a microwave discharge.

(3) Post-treatment: Introduction of the monomer vapor is stopped, the plasma discharge is stopped at the same time, vacuumizing is continued, the vacuum degree of the reaction chamber is kept to 60 mTorr for 2 min, then compressed air is introduced, to an atmospheric pressure, and then the substrate is taken out.

The dielectric constant of the coating obtained by the above process is 2.45, and the aluminum material after coating is subjected to a cold and heat cycle impact test. The results are as follows:

| Test substrate | Experimental conditions | Times of cycle | Experiment time | Result detection |
|---|---|---|---|---|
| Aluminum substrate | −40° C. ~ +75° C. | 25 | 2 h | No impact on appearance Good performance |

The effects of a humid heat alternating test of the above-mentioned coated aluminum materials are as follows:

| Experimental conditions | Temperature | | 55° C. | | | | |
|---|---|---|---|---|---|---|---|
| | Humidity | | 75% | 80% | 85% | 90% | 95% |
| Aluminum material | Time | 12 h | Pass | Pass | Pass | Pass | Pass |
| | Time | 24 h | Pass | Pass | Pass | Pass | Pass |
| | Time | 36 h | Pass | Pass | Pass | Pass | Pass |
| | Time | 48 h | Pass | Pass | Pass | Pass | Pass |

Embodiment C3

A preparation method for a high-insulation nano-protective coating, comprising the following steps: (1) a pre-treatment step; (2) a treatment/generation step for high-insulation coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 80 mTorr, a mixture of inert gas Ar and He is introduced, and a movement mechanism is turned on so that the substrate moves.

In step (1), the substrate is a solid material. The solid material can be a block polytetrafluoroethylene plate and an electrical component, and any interface of the block polytetrafluoroethylene plate can be exposed to and used in the GJB150.10A-2009 mold test environment after a mold-proof coating is prepared on the surface. Any interface of the electrical component can be exposed to and used in the environment described in the international industrial waterproof grade standard IPX7 after a waterproof and electrical breakdown resistant coating is prepared on the surface.

In step (1), the reaction chamber can be a rotating chamber with a volume 480 L, the temperature of the reaction chamber can be controlled at 50° C., and the flow rate of the inert gas can be 60 SCCM.

In step (1), the substrate can be moved to perform a circle movement at a speed of 9 rpm.

(2) Preparation of a high-insulation coating: A monomer vapor is introduced into the reaction chamber to achieve a vacuum degree of 120 mTorr. Plasma discharge is turned on for chemical vapor deposition, and a high-insulation nano-coating is prepared via chemical vapor deposition on a surface of the substrate.

The monomer vapor composition can be: a mixture of three low dipole moment organic monomers and three polyfunctional unsaturated hydrocarbons and hydrocarbon derivatives, and the mass fraction of the polyfunctional unsaturated hydrocarbons or hydrocarbon derivatives in the monomer vapor is 46%.

The monomer vapor can be atomized and volatilized through a feeding pump and is then introduced into the reaction chamber at a low pressure of 80 mTorr, and the flow rate of the introduced monomer vapor is 280 μL/min.

The three low dipole moment organic monomers can be: poly-p-dichlorotoluene, 1,8-diiodoperfluorooctane, perfluorodecyl ethyl iodide, and 1,1,4,4-tetraphenyl-1,3-butadiene.

The three polyfunctional unsaturated hydrocarbons and hydrocarbon derivatives can be: 1,4-pentadiene, tripropylene glycol diacrylate and 1,6-hexanediol diacrylate.

In step (2), a plasma discharge process can be performed for chemical vapor deposition. The plasma discharge process during the deposition process can be a pulse discharge, and specifically includes the following deposition processes for six times.

The deposition process includes a pre-treatment stage and a coating stage. The plasma discharge power in the pre-treatment stage is 150 W, and the continuous discharge time is 450 s. Then, during the coating stage, a pulse discharge, with the power of 10 W and time of 3600 s, can be performed. The pulse discharge frequency can be 1 HZ, and the duty cycle of the pulse can be 1:500.

The plasma discharge mode in step (2) can be an electric spark discharge.

(3) Post-treatment: Introduction of the monomer vapor is stopped, the plasma discharge is stopped at the same time. Vacuumizing is continued, and the vacuum degree of the reaction chamber is kept as 120 mTorr for 3 minutes, then air is introduced to the reaction chamber until the pressure thereof reaches an atmospheric pressure, and then the substrate is taken out.

The dielectric constant of the coating obtained by the above process is 2.46, and the PTFE board after coating is subjected to GJB150.10A-2009 mold test. The results are as follows:

| PTFE board-performance test | |
|---|---|
| Water contact angle | 121° |
| Oil contact angle | 95° |
| Mold resistance grade | Grade 2 |
| Degree of surface mold spots | 6% |

Test results of an underwater immersion test for the prepared electrical component with the prepared waterproof and electrical breakdown resistant coating under different voltages are as follows:

| Resistance to underwater electricity | | | |
|---|---|---|---|
| | Time to reach 1 mA at a certain voltage | | |
| | 3.8 V | 5 V | 12.5 V |
| Embodiment C3 | >96 h | >96 h | >96 h |

IPX7 waterproof rating test (1-meter underwater immersion test for 30 minutes) results are as follows:

| IPX7 waterproof grade test | |
|---|---|
| Embodiment C3 | Electrical components work properly. |

Embodiment C4

A preparation method for a high-insulation nano-protective coating, comprising the following steps: (1) a pre-treatment step; (2) a treatment/generation step for high-insulation coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 130 mTorr, an inert gas Ar is introduced, and a movement mechanism is turned on so that the substrate moves.

In step (1), the substrate is a solid material. The solid material can be a block polytetrafluoroethylene plate and an electrical component, and any interface of the block polytetrafluoroethylene plate can be exposed to and used in the GJB150.10A-2009 mold test environment after a mold-proof coating is prepared on the surface. Any interface of the electrical component can be exposed to and used in the environment described in the international industrial waterproof grade standard IPX7 after a waterproof and electrical breakdown resistant coating is prepared on the surface.

In step (1), the volume of the reaction chamber can be 680 L, the temperature of the reaction chamber can be controlled at 50° C., and the flow rate of the inert gas can be 160 SCCM.

In step (1), the substrate can be moved to linearly reciprocate at a movement speed of 30 mm/min.

(2) Preparation of a high-insulation coating: A monomer vapor is introduced into the reaction chamber to achieve a vacuum degree of 180 mTorr, the plasma discharge is turned on for chemical vapor deposition, and a high-insulation nano-coating is prepared via chemical vapor deposition on a surface of the substrate.

The monomer vapor composition can be: a mixture of two low dipole moment organic monomers and four polyfunctional unsaturated hydrocarbons or hydrocarbon derivatives, and the mass fraction of the polyfunctional unsaturated hydrocarbon or hydrocarbon derivative in the monomer vapor is 53%.

The monomer vapor can be atomized and volatilized through a feeding pump and is then introduced into the reaction chamber at a low pressure of 100 mTorr, and the flow rate of the introduced monomer vapor can be 570 μL/min.

The two low dipole moment organic monomers can be: Polydimethylsiloxane with a molecular weight of 500 and (perfluorododecyl)ethylene.

The four polyfunctional unsaturated hydrocarbons and hydrocarbon derivatives can be: 1,3-butadiene, polyethylene glycol diacrylate, 1,6-hexanediol diacrylate and ethylene glycol diacrylate.

In step (2), a plasma discharge process can be performed for chemical vapor deposition. The plasma discharge process during the deposition process can be a pulse discharge, and specifically includes the following deposition processes for five times.

The deposition process includes a pre-treatment stage and a coating stage. The plasma discharge power in the pre-treatment stage is 600 W, and the continuous discharge time is 60 s. Then, during the coating stage, a pulse discharge, with the power of 300 W and time of 600 s, can be performed. The pulse discharge frequency is 1000 HZ, and the duty cycle of the pulse is 1:1.

The plasma discharge mode in step (2) can be a high-frequency discharge, and the waveform of the high-frequency discharge is sinusoidal.

(3) Post-treatment: Introduction of the monomer vapor is stopped. The plasma discharge is stopped at the same time. Vacuumizing is continued, and the vacuum degree of the reaction chamber is kept to 200 mTorr for 4 minutes. Then air is introduced to the reaction chamber until the pressure thereof reaches an atmospheric pressure, and then the substrate is taken out.

The dielectric constant of the coating obtained by the above process is 2.48, and a PTFE board after coating is subjected to GJB150.10A-2009 mold test and the results are as follows:

| PTFE board-performance test | |
|---|---|
| Water contact angle | 126° |
| Oil contact angle | 98° |
| Mold resistance grade | Grade 2 |
| Degree of surface mold spots | 7% |

Test results of underwater immersion test for the prepared electrical component with the prepared waterproof and electrical breakdown resistant coating under different voltages are as follows:

| Resistance to underwater electricity | | | |
|---|---|---|---|
| | Time to reach 1 mA at a certain voltage | | |
| | 3.8 V | 5 V | 12.5 V |
| Embodiment C4 | >96 h | >96 h | >96 h |

IPX7 waterproof rating test (1-meter underwater immersion test for 30 minutes) results are as follows:

| IPX7 waterproof grade test | |
|---|---|
| Embodiment C4 | Electrical components work properly. |

Embodiment C5

A preparation method for a high-insulation nano-protective coating, comprising the following steps: (1) a pre-treatment step; (2) a treatment/generation step for high-insulation coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 200 mTorr, a mixture of inert gas Ar and He is introduced, and a movement mechanism is turned on so that the substrate moves.

In step (1), the substrate is a solid material. The solid material can be a block of aluminum material, and any interface of the substrate may be exposed to an acid and alkaline test environment after an acid and alkaline resistant coating can be prepared.

In step (1), the volume of the reaction chamber can be 1000 L, the temperature of the reaction chamber can be controlled at 60° C., and the flow rate of the inert gas can be 300 SCCM.

In step (1), the substrate can be moved to reciprocate in a curve manner at a speed of 80 mm/min.

(2) Preparation of a high-insulation coating: A monomer vapor is introduced into the reaction chamber to achieve a vacuum degree of 300 mTorr, the plasma discharge is turned on for chemical vapor deposition, and a high-insulation nano-coating can be prepared via chemical vapor deposition on a surface of the substrate.

The monomer vapor composition can be: a mixture of five low dipole moment organic monomers and three polyfunctional unsaturated hydrocarbons or hydrocarbon derivatives, and the mass fraction of the polyfunctional unsaturated hydrocarbon or hydrocarbon derivative in the monomer vapor is 65%.

The monomer vapor can be atomized and volatilized through a feeding pump and is then introduced into the reaction chamber at a low pressure of 200 mTorr, and the flow rate of the introduced monomer vapor can be 1000 μL/min.

The five low dipole moment organic monomers can be: Decafluorobiphenyl, tetrafluoroethylene, iodoperfluorododecane, perfluorooctyl iodide, and 2-(perfluorobutyl) ethyl methacrylate.

The three polyfunctional unsaturated hydrocarbons and hydrocarbon derivatives can be: isoprene, tripropylene glycol diacrylate, and 1,6-hexanediol diacrylate.

The plasma discharge process during the deposition process can be a periodic alternating discharge, and specifically includes the following deposition processes for once.

The deposition process includes a pre-treatment stage and a coating stage. The plasma discharge power in the pre-treatment stage is 150 W, and the continuous discharge time is 450 s. During the coating phase, the plasma can be periodically alternating discharge output, with the power of 10 W, time of 3600 s and AC frequency of 1 Hz. The waveform of the plasma periodically alternating discharge output is a sawtooth waveform.

The plasma discharge mode in step (2) can be an intermediate-frequency discharge, and the waveform of the intermediate-frequency discharge can be a bipolar pulse.

(3) Post-treatment: The introduction of monomer vapor is stopped and the plasma discharge is stopped at the same time, the reaction chamber is filled with air to a pressure of 2000 mTorr, and then it is vacuumized to 10 mTorr. The above steps of inflating and vacuumizing are performed once. Air is introduced to the reaction chamber until the pressure thereof reaches an atmospheric pressure. The movement of the substrate is stopped, and then the substrate is taken out. The coating obtained by the above process and the coated aluminum material are tested. The test results are as follows:

| | Performance | | | |
|---|---|---|---|---|
| | Water contact angle | Oil contact angle | Adhesion | Dielectric constant |
| Embodiment C5 | 125° | 84° | Low adhesion and water droplets are easy to slide. | 2.57 |

Test results of resistance to organic solvents are as follows ("pass" means that the contact angle change is less than 5° after immersion for a period of time).

| Substrate | Chemical reagent | Time 48 h | 96 h | 144 h | 192 h |
|---|---|---|---|---|---|
| Aluminum sheet | Acetone | pass | pass | pass | pass |
| | Cyclohexane | pass | pass | pass | pass |
| | Petroleum ether | pass | pass | pass | pass |
| | Xylene | pass | pass | pass | pass |
| | n-propanol | pass | pass | pass | pass |

Acid and alkali test results are as follows ("pass" means that no corrosion occurs after experiment for a period of time).

| Substrate | Acid and alkaline reagent | Time 48 h | 9 6h | 144 h | 192 h |
|---|---|---|---|---|---|
| Aluminum sheet | Acid salt spray | pass | pass | pass | pass |
| | Neutral salt spray | pass | pass | pass | pass |
| | Alkaline salt spray | pass | pass | pass | pass |
| | 5% acetic acid solution | pass | pass | pass | pass |
| | 5% NaOH solution | pass | pass | pass | pass |

Embodiment C6

A preparation method for a high-insulation nano-protective coating, comprising the following steps: (1) a pre-treatment step; (2) a treatment/generation step for high-insulation coating; and (3) a post-treatment step.

(1) Pre-treatment: A substrate is placed in a reaction chamber of a nano-coating preparation equipment, the reaction chamber is closed and continuously vacuumized, the vacuum degree within the reaction chamber is adjusted to 160 mTorr, an inert gas Ar is introduced, and a movement mechanism is turned on so that the substrate moves.

In step (1), the substrate is a solid material. The solid material can be a block aluminum material and an electrical component, and any interface of the substrate may be exposed to an organic solvent test environment after a high-insulation coating can be prepared on its surface.

In step (1), the volume of the reaction chamber can be 400 L, the temperature of the reaction chamber can be controlled at 40° C., and the flow rate of the inert gas can be 150 SCCM.

In step (1), the substrate can be moved to reciprocate in a curve manner at a speed of 50 mm/min.

(2) Preparation of a high-insulation coating: A monomer vapor is introduced into the reaction chamber to achieve a vacuum degree of 240 mTorr. Plasma discharge is turned on for chemical vapor deposition, and a high-insulation nano-coating is prepared via chemical vapor deposition on a surface of the substrate.

The monomer vapor composition can be: a mixture of four low dipole moment organic monomers and six polyfunctional unsaturated hydrocarbons and hydrocarbon derivatives, and the mass fraction of the polyfunctional unsaturated hydrocarbons or hydrocarbon derivatives in the monomer vapor is 54%.

The monomer vapor can be atomized and volatilized through a feeding pump and is then introduced into the reaction chamber at a low pressure of 160 mTorr, and the flow rate of the introduced monomer vapor can be 680 μL/min.

The four low dipole moment organic monomers can be: 2,4,6-tris(pentadecafluoroheptyl)-1,3,5-triazine, (perfluorododecyl)ethylene, dibromo-p-xylene, and 1,1,4,4-tetraphenyl-1,3-butadiene.

The six polyfunctional unsaturated hydrocarbons and hydrocarbon derivatives can be: 1,3-butadiene, 1,4-pentadiene, tripropylene glycol diacrylate, 1,6-hexanediol diacrylate, ethylene glycol diacrylate, and neopentyl glycol diacrylate.

The plasma discharge process during the deposition process can be a periodic alternating discharge, and specifically includes the following deposition processes for four times.

The deposition process includes a pre-treatment stage and a coating stage. The plasma discharge power in the pre-treatment stage is 600 W, and the continuous discharge time is 60 s. Then, during the coating phase, the plasma can have a periodically alternating discharge output, with the power of 300 W, time of 600 s and AC frequency of 1000 Hz. The waveform of the plasma periodically alternating discharge output is a half-wave rectified waveform. The plasma discharge mode in step (2) can be a microwave discharge.

(3) Post-treatment: The introduction of monomer vapor is stopped and the plasma discharge is stopped at the same time, the reaction chamber is filled with an inert gas to a pressure of 5000 mTorr, and then it is vacuumized to 200 mTorr. The above steps of inflating and vacuumizing are performed for five times. Air is introduced to the reaction chamber until the pressure thereof reaches an atmospheric pressure. The movement of the substrate is stopped, and then the substrate is taken out. The test effects of the above-mentioned coated aluminum materials are as follows:

(1) Hydrophobicity and oleophobicity

| | Performance | | | |
|---|---|---|---|---|
| | Water contact angle | Oil contact angle | Adhesion | Dielectric constant |
| Embodiment C6 | 120° | 80° | Low adhesion and water droplets are easy to slide. | 2.46 |

Test results of an underwater immersion test of the coated electrical components under different voltages are as follows:

| Resistance to underwater electricity | | | |
|---|---|---|---|
| | Time to reach 1 mA at a certain voltage | | |
| | 3.8 V | 5 V | 12.5 V |
| Embodiment C6 | >120 h | >120 h | >120 h |

Test results of resistance to organic solvents are as follows ("pass" means that the contact angle change is less than 5° after immersion for a period of time).

| Substrate | Chemical reagent | Time 48 h | 96 h | 144 h | 192 h |
|---|---|---|---|---|---|
| Aluminum material | Acetone | pass | pass | pass | pass |
| | Cyclohexane | pass | pass | pass | pass |
| | Petroleum ether | pass | pass | pass | pass |
| | Xylene | pass | pass | pass | pass |
| | n-propanol | pass | pass | pass | pass |

Acid and alkali test results are as follows ("pass" means that no corrosion occurs after experiment for a period of time).

| Substrate | Acid and alkaline reagent | Time 48 h | 96 h | 144 h | 192 h |
|---|---|---|---|---|---|
| Aluminum material | Acid salt spray | pass | pass | pass | pass |
| | Neutral salt spray | pass | pass | pass | pass |
| | Alkaline salt spray | pass | pass | pass | pass |
| | 5% acetic acid solution | pass | pass | pass | pass |
| | 5% NaOH solution | pass | pass | pass | pass |

FIG. 1 is a flowchart of a method 100 in accordance with an embodiment of the present invention. The method 100 is for generating an organosilicon nano-protective coating. At block 101, the method 100 starts by placing a substrate in a reaction chamber of a nano-coating preparation equipment. In some embodiments, the reaction chamber can be continuously vacuumized. In some embodiments, a vacuum degree in the reaction chamber is 10 to 200 mTorr. At block 103, the method 100 continues to introduce an inert gas. In some embodiments, the inert gas includes helium (He) and/or argon (Ar)

At block 105, the method 100 continues by turning on a movement mechanism so that the substrate is moved in the reaction chamber. In some embodiments, the movement mechanism can be a carrier, an arm, a holder, etc. In some embodiments, the substrate is moved in a linear manner or a curved manner (e.g., a circular movement, an elliptical movement, a planetary movement, or a spherical movement).

At block 107, the method 100 continues by introducing a monomer vapor into the reaction chamber. In some embodiments, the monomer vapor can be introduced into the reaction chamber to achieve a vacuum degree of 30-300 mTorr. In some embodiments, the monomer vapor can include a mixture of (i) at least one organosilicon monomer containing a double bond, Si—Cl, Si—O—C, Si—N—Si, Si—O—Si structure or an annular structure and (ii) at least one polyfunctional unsaturated hydrocarbon or hydrocarbon derivative. In some embodiments, the mass fraction of the polyfunctional unsaturated hydrocarbon or hydrocarbon derivative in the monomer vapor can be 15-65%. In some embodiments, the flow rate of the monomer vapor is 10-1000 μL/min.

At block 109, the method 100 continues by turning on a plasma discharge for chemical vapor deposition. At block 111, the method 100 continues by forming an organosilicon nano-coating on a surface of the substrate by the chemical vapor deposition. In some embodiments, the organosilicon nano-coating can be formed in two stages, a pre-treatment stage and a coating stage. In the pre-treatment stage, the plasma discharge power can be set as 150-600 W for a continuous discharge time 60-450 s. In the coating stage, the plasma discharge power can be adjusted to 10-150 W for 600-3600 s.

In some embodiments, the plasma discharge includes a periodic alternating discharge. The periodic alternating discharge can correspond to a waveform. The waveform can include at least one of a sawtooth waveform, a sine waveform, or a square wave waveform.

In some embodiments, the method 100 can include introducing oxygen and/or water vapor at a flow rate of 10-100 μL/min so as to harden the organosilicon nano-coating.

In some embodiments, the method can be used to generate a high-insulation nano-protective coating. In such embodiments, the monomer vapor can include at least one low dipole moment organic monomer and at least one polyfunctional unsaturated hydrocarbon or hydrocarbon derivative.

From the foregoing, it will be appreciated that specific embodiments of the technology have been described herein for purposes of illustration, but that various modifications may be made without deviating from the disclosure. In addition, many of the elements of one embodiment may be combined with other embodiments in addition to or in lieu of the elements of the other embodiments. Accordingly, the disclosure is not limited except as by the appended claims.

The invention claimed is:

1. A method for generating a nano-protective coating, comprising:

placing a substrate in a reaction chamber of a nano-coating preparation equipment, wherein the reaction chamber is continuously vacuumized, and wherein a vacuum degree in the reaction chamber is 10 to 200 mTorr;

introducing an inert gas, wherein the inert gas includes helium (He) and/or argon (Ar);

turning on a movement mechanism so that the substrate is moved in the reaction chamber;

introducing a monomer vapor into the reaction chamber to achieve a vacuum degree of 30-300 mTorr;

turning on a plasma discharge for a chemical vapor deposition; and forming an organosilicon nano-coating on a surface of the substrate by the chemical vapor deposition;

wherein the monomer vapor includes a mixture of at least one organosilicon monomer containing a double bond, Si—Cl, Si—O—C, Si—N—Si, Si—O—Si structure or an annular structure and at least one polyfunctional unsaturated hydrocarbon;

wherein a mass fraction of the polyfunctional unsaturated hydrocarbon in the monomer vapor is 15-65%; and wherein a flow rate of the monomer vapor is 10-1000 μL/min.

2. The method of claim 1, further comprising:
stopping introducing the monomer vapor;
turning off the plasma discharge;
continuing to maintain a vacuum degree of the reaction chamber to 10-200 mTorr for at least one minute;
introducing air to the reaction chamber until a pressure of the reaction chamber equals to an atmospheric pressure;
turning off the movement mechanism such that the substrate is stopped; and
removing the substrate from the reaction chamber.

3. The method of claim 1, wherein the substrate is moved in a linear manner.

4. The method of claim 1, wherein the substrate is moved in a curved manner.

5. The method of claim 4, wherein the curved manner corresponds to a circular movement, an elliptical movement, a planetary movement, or a spherical movement.

6. The method of claim 1, wherein the substrate includes a solid material including an electronic product, an electrical component, a semi-finished electronic assembly, a printed circuit board (PCB), a metal plate, or a polytetrafluoroethylene sheet.

7. The method of claim 1, wherein the reaction chamber includes a rotating chamber or a cubic chamber with a volume of 50-1000 L, and wherein a temperature of the reaction chamber is controlled at 30-60° C., and wherein a flow rate of the inert gas is 5-300 SCCM.

8. The method of claim 1, further comprising:
forming the organosilicon nano-coating on the surface of the substrate in a pre-treatment stage and a coating stage,
wherein, in the pre-treatment stage, a plasma discharge power is 150-600 W and a continuous discharge time is 60-450 s, and
wherein, in the coating stage, the plasma discharge power is adjusted to 10-150 W and the continuous discharge time is 600-3600 s.

9. The method of claim 1, wherein the plasma discharge includes a periodic alternating discharge, and wherein the periodic alternating discharge corresponds to a waveform, and wherein the waveform includes at least one of a sawtooth waveform, a sine waveform, or a square wave waveform.

10. The method of claim 1, wherein the organosilicon monomer includes at least one of: allyltrimethoxysilane, vinyltriethoxysilane, vinyltrimethylsilane, 3-butenyltrimethylsilane, Vinyltris(methylethylketoxime)silane, tetramethyldivinyldisiloxane, or 1,2,2-trifluorovinyltriphenylsilane.

11. The method of claim 1, wherein the organosilicon monomer includes at least one of: triphenylchlorosilane, methylvinyldichlorosilane, trichloro (3,3,3-trifluoropropyl) silane, trifluoropropylmethyldichlorosilane, dimethylphenylchlorosilane, tributylchlorosilane, or benzyldimethylchlorosilane.

12. The method of claim 1, wherein the organosilicon monomer includes at least one of: tetramethoxysilane, trimethoxyhydrosiloxane, n-octyltriethoxysilane, phenyltriethoxysilane, vinyltris (2-methoxythoxy)silane, triethylvinylsilane, hexaethylcyclotrisiloxane, 3-(methacryloyloxy) propyltrimethoxysilane, phenyltris(trimethylsiloxy)silane, diphenyldiethoxysilane, dodecyltrimethoxysilane, n-octyltriethoxysilane, dimethoxysilane or 3-chloropropyltrimethoxysilane.

13. The method of claim 1, wherein the organosilicon monomer includes at least one of: hexamethyldisilazane, hexamethylcyclotrisilaneamino, hexamethyldisilazane, or hexamethyl disiloxane.

14. The method of claim 1, wherein the organosilicon monomer includes at least one of: thylcyclotrisiloxane, octamethylcyclotetrasiloxane, hexaphenylcyclotrisiloxane, decamethylcyclopentasiloxane, octaphenylcyclotetra siloxane, triphenylhydroxysilane, diphenyldihydroxysilane, bis (triphenylsilyl) ester, trifluoropropylmethylcyclotrisiloxane, 2,4,4-tetramethyl-6,6,8,8-tetraphenylcyclotetrasiloxane, tetramethyltetravinylcyclotetrasiloxane, (3-glycidyloxypropyl) triethoxysilane, and 3-glycidyloxypropyltrimethoxysilane.

15. The method of claim 1, further comprising introducing oxygen at a flow rate of 10-100 μL/min so as to harden the organosilicon nano-coating.

16. The method of claim 1, further comprising introducing water vapor at a flow rate of 10-100 μL/min so as to harden the organosilicon nano-coating.

17. A method for generating a nano-protective coating, comprising:
placing a substrate in a reaction chamber of a nano-coating preparation equipment, wherein the reaction chamber is continuously vacuumized, and wherein a vacuum degree in the reaction chamber is 10 to 200 mTorr;
introducing an inert gas, wherein the inert gas includes helium (He) and/or argon (Ar);
turning on a movement mechanism so that the substrate is moved in the reaction chamber;
introducing a monomer vapor into the reaction chamber to achieve a vacuum degree of 30-300 mTorr;
turning on a plasma discharge for chemical vapor deposition;
forming an organosilicon nano-coating on a surface of the substrate by the chemical vapor deposition; and
introducing oxygen and/or water vapor at a flow rate of 10-100 μL/min so as to harden the organosilicon nano-coating;
wherein the monomer vapor includes a mixture of at least one organosilicon monomer containing a double bond, Si—Cl, Si—O—C, Si—N—Si, Si—O—Si structure or an annular structure and at least one polyfunctional unsaturated hydrocarbon;
wherein a mass fraction of the polyfunctional unsaturated hydrocarbon in the monomer vapor is 15-65%; and
wherein a flow rate of the monomer vapor is 10-1000 μL/min.

18. The method of claim 17, further comprising:
maintaining a plasma discharge power to a value between 50-100 W for 60-180 s so as to harden the organosilicon nano-coating.

19. The method of claim 17, wherein the organosilicon monomer includes: allyltrimethoxysilane, vinyltriethoxysilane, vinyltrimethylsilane, 3-butenyltrimethylsilane, Vinyltris(methylethylketoxime)silane, tetramethyldivinyldisiloxane, and 1,2,2-trifluorovinyltriphenylsilane.

20. The method of claim 17, wherein the organosilicon monomer includes: triphenylchlorosilane, methylvinyldichlorosilane, trichloro(3,3,3-trifluoropropyl) silane, trifluoropropylmethyldichlorosilane, dimethylphenylchlorosilane, tributylchlorosilane, and benzyldimethylchlorosilane.

21. The method of claim 17, wherein the organosilicon monomer includes: tetramethoxysilane, trimethoxyhydrosiloxane, n-octyltriethoxysilane, phenyltriethoxysilane, vinyltris(2-methoxythoxy)silane, triethylvinylsilane, hexaethylcyclotrisiloxane, 3-(methacryloyloxy)propyltrimethoxysilane, phenyltris(trimethylsiloxy)silane, diphenyldiethoxysilane, dodecyltrimethoxysilane, n-octyltriethoxysilane, dimethoxysilane, and 3-chloropropyltrimethoxysilane.

22. The method of claim 17, wherein the organosilicon monomer includes: hexamethyldisilazane, hexamethylcyclotrisilaneamino, hexamethyldisilazane, and hexamethyl disiloxane.

23. The method of claim 17, wherein the organosilicon monomer includes: hexamethylcyclotrisiloxane, octamethylcyclotetrasiloxane, hexaphenylcyclotrisiloxane, decamethylcyclopentasiloxane, octaphenylcyclotetra siloxane, triphenylhydroxysilane, diphenyldihydroxysilane, bis(triphenylsilyl) ester, trifluoropropylmethylcyclotrisiloxane, 2,2,4,4-tetramethyl-6,6,8,8-tetraphenylcyclotetrasiloxane, tetramethyltetravinylcyclotetrasiloxane, (3-glycidyloxypropyl) triethoxysilane, and 3-glycidyloxypropyltrimethoxysilane.

24. The method of claim 17, wherein the polyfunctional unsaturated hydrocarbon includes:

1,3-butadiene, isoprene, 1,4-pentadiene, ethoxylated trimethylolpropane triacrylate, tripropylene glycol diacrylate, polyethylene glycol diacrylate, 1,6-hexanediol diacrylate, ethylene glycol diacrylate, diethylene glycol divinyl ether, or neopentyl glycol diacrylate.

25. A method for generating a nano-protective coating, comprising:

placing a substrate in a reaction chamber of a nano-coating preparation equipment, wherein the reaction chamber is continuously vacuumized, and wherein a vacuum degree in the reaction chamber is 10 to 200 mTorr;

introducing an inert gas, wherein the inert gas includes helium (He) and/or argon (Ar);

turning on a movement mechanism so that the substrate is moved in the reaction chamber;

introducing a monomer vapor into the reaction chamber to achieve a vacuum degree of 30-300 mTorr;

turning on a plasma discharge for chemical vapor deposition; and forming an organosilicon nano-coating on a surface of the substrate by the chemical vapor deposition;

wherein the monomer vapor includes at least one low dipole moment organic monomer and at least one polyfunctional unsaturated hydrocarbon;

wherein a mass fraction of the polyfunctional unsaturated hydrocarbon in the monomer vapor is 15-65%; and wherein a flow rate of the monomer vapor is 10-1000 μL/min.

26. The method of claim 25, wherein the low dipole moment organic monomer includes:

p-xylene, benzene, toluene, carbon tetrafluoride, a-methylstyrene, poly-p-xylylene, dimethylsiloxane, polydimethylsiloxane with a molecular weight of 500-50,000, allylbenzene, decafluorobiphenyl, decafluorobenzophenone, perfluoroallylbenzene, tetrafluoroethylene, hexafluoropropylene, 1H, 1H-perfluorooctylamine, iodoperfluorododecane, perfluorotributylamine, 1,8-diiodoperfluorooctane, tridecafluorohexyl iodide, nonafluorobutyl iodide, perfluorodecyl iodide, perfluorooctyl iodide, 1,4-bis(2',3'-epoxypropyl) perfluorobutane, perfluoro-2-methyl-2-pentene, 2-(perfluorobutyl) ethyl methacrylate, 2-(perfluorooctyl) ethyl methacrylate, 2-(perfluorooctyl) iodoethane, perfluorodecyl ethyl iodide, 1,1,2,2-tetrahydroperfluorohexyl iodide, perfluorobutyl ethylene, 1H,1H,2H-Perfluoro-1-decene, 2,4,6-tris(pentadecafluoroheptyl)-1,3,5-triazine, (perfluorohexyl)ethylene, 3-(Perfluoro-n-octyl) propenoxide, perfluoro-compound, (perfluorododecyl) ethylene, 1-Iodo-1H,1H,2H,2H-perfluorotetradecane, dibromo-p-xylene, and 1,1,4,4-tetraphenyl-1,3-butadiene.

27. The method of claim 25, wherein the polyfunctional unsaturated hydrocarbon includes: 1,3-butadiene, isoprene, 1,4-pentadiene, ethoxylated trimethylolpropane triacrylate, tripropylene glycol diacrylate, polyethylene glycol diacrylate, 1,6-hexanediol diacrylate, ethylene glycol diacrylate, diethylene glycol divinyl ether or neopentyl glycol diacrylate.

* * * * *